US007352874B2

(12) United States Patent
Raptopolous et al.

(10) Patent No.: US 7,352,874 B2
(45) Date of Patent: Apr. 1, 2008

(54) APPARATUS FOR ACOUSTICALLY IMPROVING AN ENVIRONMENT AND RELATED METHOD

(76) Inventors: Andreas Raptopolous, 6 Norfolk House, 4 Maidstone Buildings Mews, London SE1 1GJ (GB); Michael Kieslinger, Landgutgasse 25/17, 100 Vienna (AT)

( * ) Notice: Subject to any disclaimer, the term of this patent is extended or adjusted under 35 U.S.C. 154(b) by 704 days.

(21) Appl. No.: 10/145,097

(22) Filed: May 15, 2002

(65) Prior Publication Data

US 2003/0002687 A1 Jan. 2, 2003

Related U.S. Application Data

(63) Continuation-in-part of application No. PCT/GB00/02360, filed on Jun. 16, 2000, now abandoned.

(30) Foreign Application Priority Data

Nov. 16, 1999 (GB) ..... 9927131.4

(51) Int. Cl.
*H04R 25/00* (2006.01)

(52) U.S. Cl. ..... 381/152; 381/94.3

(58) Field of Classification Search ..... 381/73.1, 381/94.2, 94.3, 152, 354
See application file for complete search history.

(56) References Cited

U.S. PATENT DOCUMENTS 4,052,720 A 10/1977 McGregor et al.
4,423,289 A * 12/1983 Swinbanks ..... 381/71.14
4,438,526 A 3/1984 Thomalla
4,686,693 A 8/1987 Ritter
4,771,472 A * 9/1988 Williams et al. ..... 381/94.2
5,024,388 A 6/1991 Kaneko et al.
5,105,377 A 4/1992 Ziegler, Jr.
5,315,661 A * 5/1994 Gossman et al. ..... 381/71.1
5,355,418 A 10/1994 Kelsey et al.
5,371,657 A * 12/1994 Wiscombe ..... 362/103
5,781,640 A 7/1998 Nicolino, Jr.
6,446,751 B1 * 9/2002 Ahuja et al. ..... 181/295
7,003,120 B1 * 2/2006 Smith et al. ..... 381/61

FOREIGN PATENT DOCUMENTS

JP 03276998 12/1991
WO WO0145082 12/2000

* cited by examiner

*Primary Examiner*—Curtis Kuntz
*Assistant Examiner*—Alexander Jamal
(74) *Attorney, Agent, or Firm*—Hunton & Williams LLP

(57) ABSTRACT

The invention provides an apparatus and related method for acoustically improving an environment. In an embodiment of the invention, an apparatus comprises a partitioning means in the form of a curtain for producing a discontinuity in a sound conducting medium, such as air, and for absorbing sound. One or more microphones serve for receiving acoustic energy and for converting it into electrical signals for supply to a digital signal processor. The processor employs an algorithm for analyzing the electrical signals and providing a control signal based on such analysis. In response to the control signal, an electrical output signal is generated and converted into sound.

40 Claims, 18 Drawing Sheets

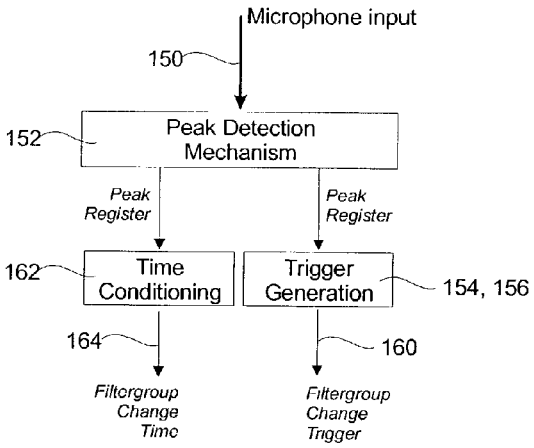
Fig. 24
Fig. 25
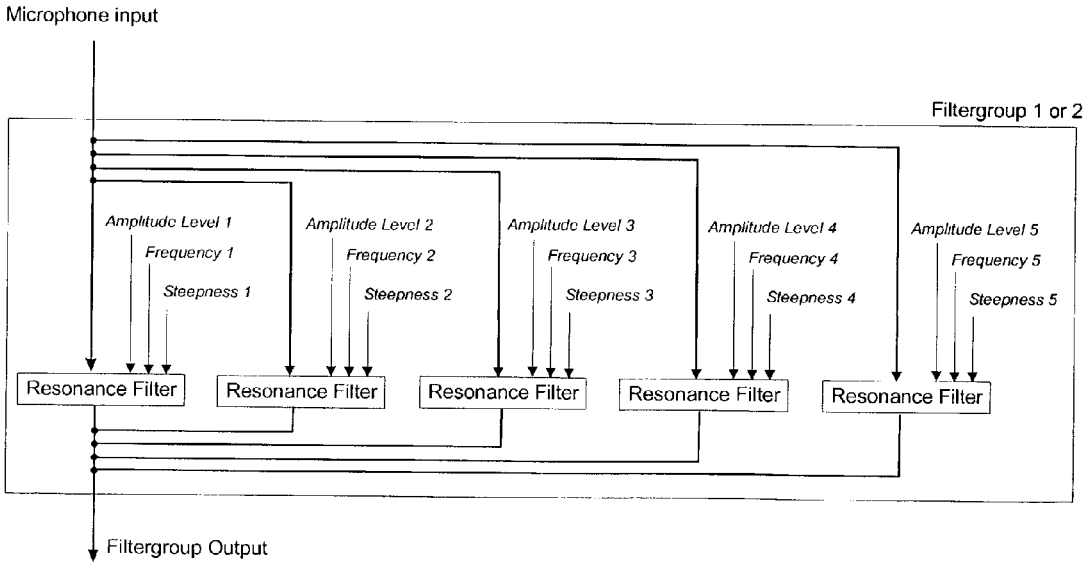

APPARATUS FOR ACOUSTICALLY IMPROVING AN ENVIRONMENT AND RELATED METHOD

CROSS-REFERENCE TO RELATED APPLICATION

The present application is a continuation-in-part of International Application PCT/GB00/02360, with an international filing date of Jun. 16, 2000, published in English under PCT Article 21(2) and now abandoned.

BACKGROUND OF THE INVENTION

1. Field of Invention

The present invention relates to an apparatus for acoustically improving an environment and to a related method.

2. Description of Related Art

Noise has been recognized as a major problem in industrial, office, and domestic environments for many years now. Advances in materials technology have provided some solutions. However, the solutions have all addressed the problem in the same way, namely: the sound environment has been improved by decreasing noise levels in a controlled space. This relatively inflexible approach has been regarded as a major design guideline in the design of spaces as far as noise abatement is concerned.

In particular, U.S. Pat. No. 5,355,418 describes a hearing aid for wearing as an ear piece, which is designed to monitor ambient noise for frequency components above a pre-selected threshold level and to filter out such frequencies utilizing an adaptive digital filter.

U.S. Pat. No. 5,105,377 concerns an active noise cancellation system arranged to sense residual noise and to generate an electronic waveform for activating an acoustic activator to produce an acoustic cancellation signal. In this system, an adaptive filter is employed whose filtering characteristics are adjusted on the basis of the residual noise and of the estimated effects of the cancellation signal as well as the system impulse response. The adaptive filter thus filters the estimated noise to generate the cancellation signal.

U.S. Pat. No. 5,315,661 concerns an arrangement for sound reduction employing a passive sound absorbing panel, a sensor, and an activator for actively attenuating sound signals received by the sensor.

SUMMARY OF THE INVENTION

The present invention seeks to provide a more adaptable apparatus for, and method of, acoustically improving an environment.

According to an embodiment of the invention, an apparatus for acoustically improving an environmental space comprises: a partitioning screen for producing a discontinuity in a sound conducting medium in the environmental space, the partitioning screen acting as a sound absorber; means for receiving acoustic energy from the environmental space and for converting the acoustic energy into an electric input signal; means for analyzing the input signal and for providing a control signal based on such analysis; means responsive to the control signal for generating an electrical output signal; and output means for converting said output signal into sound.

Sounds are interpreted as pleasant or unpleasant, i.e., wanted or unwanted, by the human brain. For ease of reference, unwanted sounds are hereinafter referred to as "noise".

The means for analyzing may include a micro-processor or digital signal processor (DSP). A desktop or laptop computer can also be used. In either case an algorithm is employed to define the response of the apparatus to sensed noise. Noise to sound transformation is advantageously based on the algorithm, which is executed by the processor or computer chip.

The algorithm advantageously works on the basis of building a real time transformation of ambient noise to create a more pleasing sound environment. The algorithm analyzes the structural elements of the ambient noise and produces a transformation that either masks the original noise or emphasizes harmonic elements in it in order to produce a pleasant sound environment.

A preferred algorithm employs a series of band-pass filters, whose center frequencies are multiples of a base frequency (i.e. lowest frequency). The algorithm is capable of recording the mean energy of the frequency bands positioned symmetrically around those frequencies and of using those indexes to adjust the relative levels of output of the corresponding filtering functions in order to create a smoother sound output.

In a particularly preferred embodiment, the algorithm is modeled on the human auditory perception system and relevant experimental data available in handbooks of experimental psychology of hearing. Several case studies have been carried out in different situations/locations with diverse sound/noise environments. Digital recordings were made and the sound signals were then played back in different locations. The sound signals were also analyzed with spectrograms and their results were compared to spectrograms of pieces of music and recordings of natural sounds. The analysis of the data has resulted in design criteria that were incorporated into the algorithm. The algorithm tunes the sound signal by analyzing, in real time, incoming noise and produces a sound output which can be tuned by the user to match different environments, activities, or aesthetic preferences. In an embodiment of the invention, the algorithm is programmed in MAX, a programming language available for Apple Macintosh™ computers. However, other programming languages can be used, the identification and implementation of which is apparent to one of skill in the art. An example of the algorithm is described below.

The digital signal processing unit may be any conventional programmable processor. In an embodiment of the invention, the physical size of the processor is approximately 100 by 150 mm. Such a unit may include circuitry for data input through a PC using a parallel port. In an alternative embodiment of the invention, a non-reprogrammable DSP chip may be used instead and the parallel port would be omitted.

The apparatus preferably has a partitioning device in the form of a flexible curtain. However, it will be appreciated that such device may also be solid.

The curtain preferably has one or more rigid or semi-rigid portions, which carry the output means.

The curtain may be formed from a plurality of modules manufactured from a flexible material, such as polyurethane or silicon rubber. Preferably each module has a substantially constant thickness of between 1 and 2 mm. Modules can be assembled together to form screens or space dividers of different heights and constant width. A basic module size is typically 1200×400-450 mm (width by height).

Each module advantageously includes an electrically conductive pathway molded integrally within or deposited on the curtain. In an embodiment of the invention, the conductive pathway is deposited on the curtain via a screen printing technique.

Two different modules may be used to create a screen: the first curtain module may have conductive pathways and incorporate the audio output means, and the second may also have conductive pathways and may connect to a power supply via a transformer, and to other curtain module(s) via the conductive pathways.

In a preferred embodiment, the second module(s) may include a DSP unit which performs digital signal processing on the input signal to produce a transformed signal, which is then output to one or more output devices. Power may be provided by a rechargeable lithium battery or a main voltage supply via a transformer. Optionally the DSP unit may be configured to accept an infra-red input, e.g., remote control device, to the curtain, thereby allowing a user to tune or switch on/off the output pleasant sound environment.

The curtain may also comprise two or more materials of differing acoustic properties. The materials may be separated by a space or volume, which may be evacuated or filled with a fluid, such as air or other material. At least one of the surfaces may be relatively stiff so as to act as a sound reflector. Examples of a stiff material include: glass, steel, and laminates, such as carbon-fiber epoxy or Kevlar™ epoxy. Such a stiff material may also be combined with a sound absorption material such as foam or woven fabrics, such as velvet or woven Kevlar™.

A particularly effective curtain includes a semi-flexible modular curtain formed from a sandwich material of aluminum honeycomb core and having a latex, polyurethane, or elastomer, e.g., rubber, skin.

The partitioning medium may be translucent for visual appeal. However, it will be appreciated that it may also be opaque or transparent.

According to another embodiment of the invention, a method of manufacturing a curtain comprises the steps of: embedding an electrically conductive pathway in, or on, a flexible material, the electrical pathway being adapted to connect to a means for receiving audio energy and a means for converting said energy into a signal, so as to modify its composition and to provide, in use, a pathway for said modified signal to an audio output means.

The electronic sound screening system of the present invention provides a pleasant sound environment by transforming noise into non-disturbing sound. The partitioning device can be seen as a smart textile that has a passive and an active element incorporated. The passive element acts as a sound absorber bringing the noise level down by several decibels. The active element then transforms the remaining noise into pleasant sound. The latter is achieved by recording and then processing the original sound signal with the use of an electronic system. The transformed sound signal may then be played back through speakers connected to the partitioning device.

The invention has a myriad of applications. For example, it may be used in shops, offices, hospitals, or schools as an active noise treatment system.

Instead of resolving complex equations in order to construct a system that cancels noise in well described and controlled cavities (like the interiors of a car or the cavity of the human ear), a universal system is provided that functions in any sound environment by modifying its output.

Preferably, the invention reduces the noise level down by 6-12 decibels.

The foregoing, and other features and advantages of the invention, will be apparent from the following, more particular description of the preferred embodiments of the invention, the accompanying drawings, and the claims.

BRIEF DESCRIPTION OF THE DRAWINGS

For a more complete understanding of the present invention, the objects and advantages thereof, reference is now made to the following descriptions taken in connection with the accompanying drawings in which:

FIGS. 22-25 show circuit blocks representing the operation of the algorithm employed in the electrical circuit of FIG. 11.

DETAILED DESCRIPTION OF THE PREFERRED EMBODIMENTS

Figure 1:
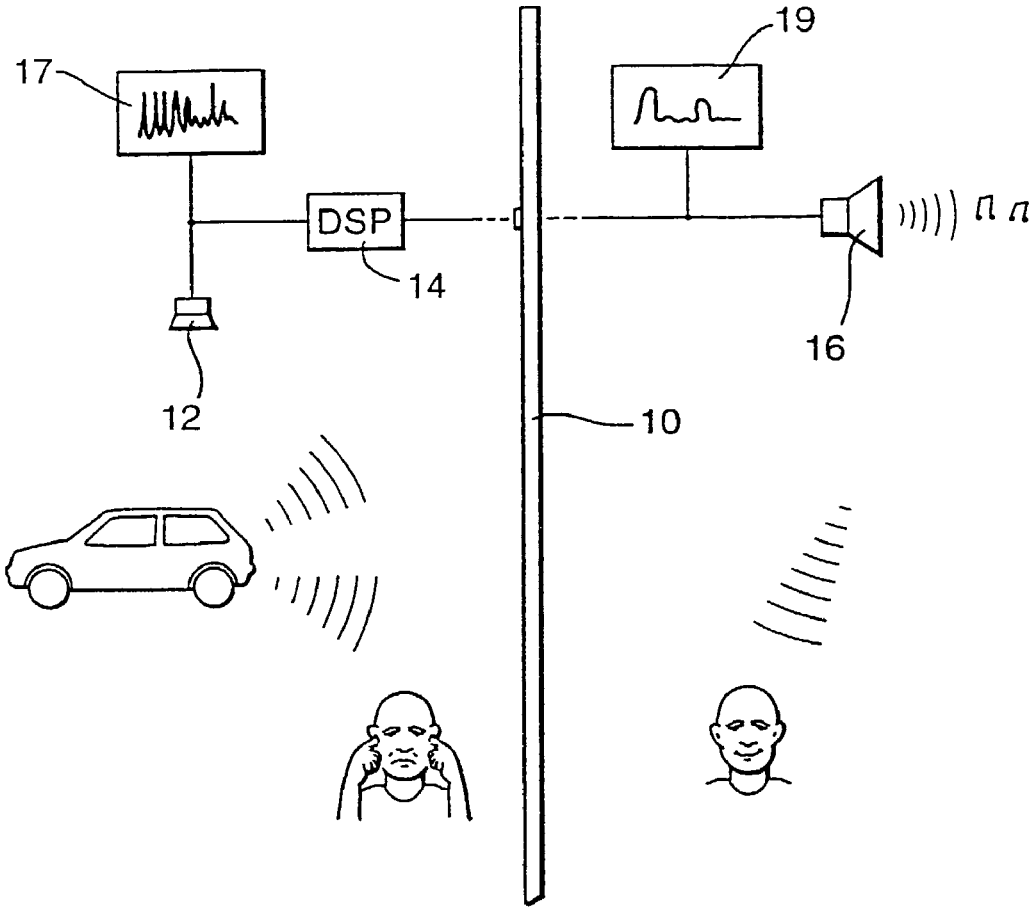
FIG. 1 is a general schematic diagram illustrating operation of the invention.

Preferred embodiments of the present invention and their advantages may be understood by referring to FIGS. 1-25, wherein like reference numerals refer to like elements. The inventive concept is directed to acoustically improving a sound environment. Generally, the system comprises three elements: a microphone for sensing environmental sound; a processing unit for transforming it or analyzing it, and generating responses; and an output such as a speaker for outputting the responsive sound back into the environment. Although the embodiments described herein integrate these elements on a sound reflecting and/or absorbing medium that provides a physical separation of the user from the noise source, the inventive concept, nevertheless, can be adapted such that the elements are arranged freely in space or within a medium not separating the user from the noise source.

Referring to FIG. 1, an apparatus for acoustically improving an environment comprises a partitioning device in the form of, for example, a curtain 10. The apparatus also comprises a number of microphones 12, which may be positioned at a distance from the curtain 10 or which may be mounted on, or integrally formed in, a surface of the curtain 10. The microphones 12 are electrically connected to a digital signal processor (DSP) 14 and thence to a number of loudspeakers 16, which again may be positioned at a distance from the curtain or mounted on, or integrally formed in, a surface of the curtain 10. The curtain 10 produces a discontinuity in a sound conducting medium, such as air, and acts primarily as a sound absorbing device.

Preferably, the curtain 10 comprises a flexible material, for example a translucent velvet textile woven from a transparent nylon or monofilament polyester yarn, or a molded synthetic rubber or polyurethane sheet. Other suitable materials include woven fabrics and laminates formed from KEVLAR™ or carbon-fiber epoxy. Such materials all have good sound absorbing properties. The material may also be woven or overprinted with visual designs, information or colors, to provide an aesthetically pleasing result.

Figure 2:
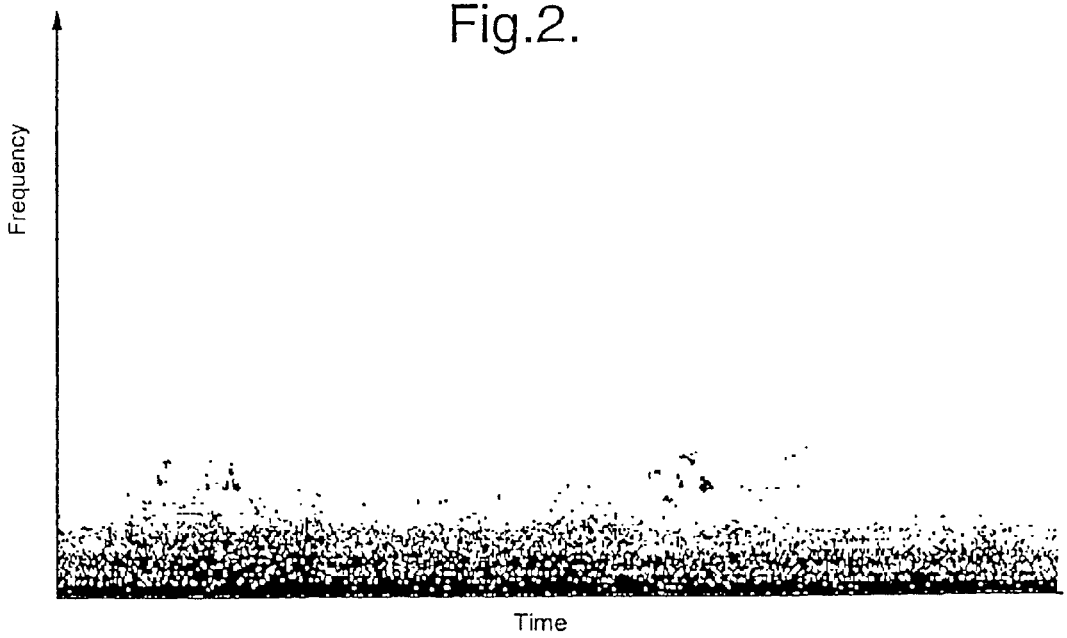
FIG. 2 and FIG. 3 show spectrograms of street noise prior to and after acoustic transformation by the invention respectively.
Figure 3:
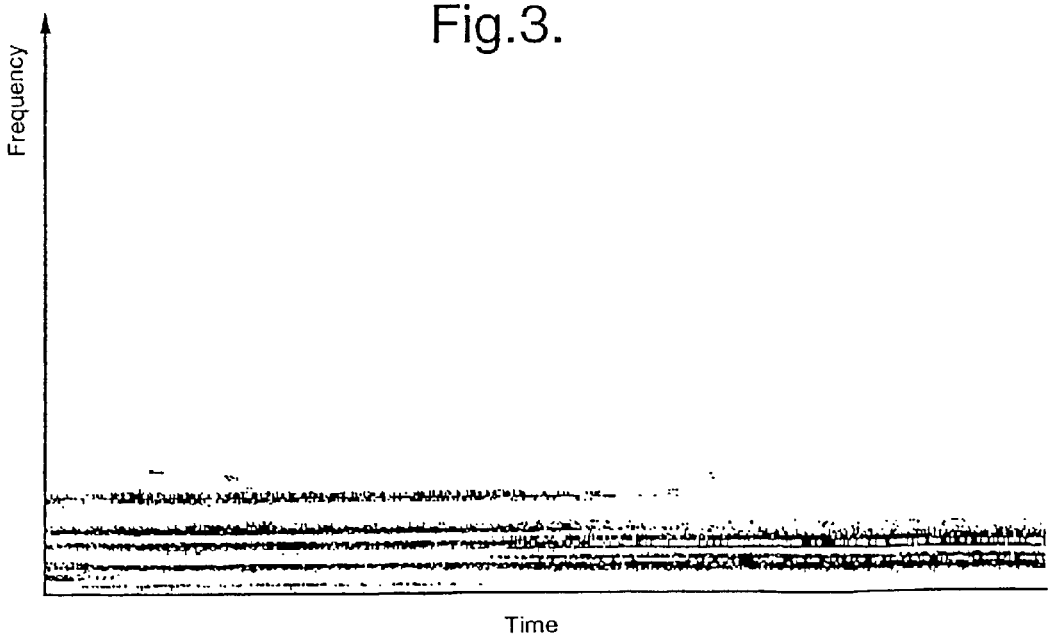

The microphones 12 receive ambient noise from the surrounding environment and convert such noise into electrical signals for supply to the DSP 14. A spectrogram 17 representing such noise is illustrated in FIG. 1, and an example of such a spectrogram is shown in FIG. 2. The DSP 14 employs an algorithm for analyzing the electrical signals received from microphones 12 and for providing a control signal based on such analysis. An output signal is generated responsive to the control signal for supply to the loudspeakers 16. A spectrogram 19 representing such modified electrical signals is illustrated in FIG. 1 and an example of such a spectrogram is shown in FIG. 3. The sound issuing from the loudspeakers 16 is preferably an acoustic signal representing either the original ambient noise from which unwanted sounds and noise have been filtered out or masked and/or to which harmonic elements have been added to produce a pleasing quality. However, it is also possible for the sound issuing from the loudspeakers to be anti-noise for canceling out the original noise.

Figure 4:
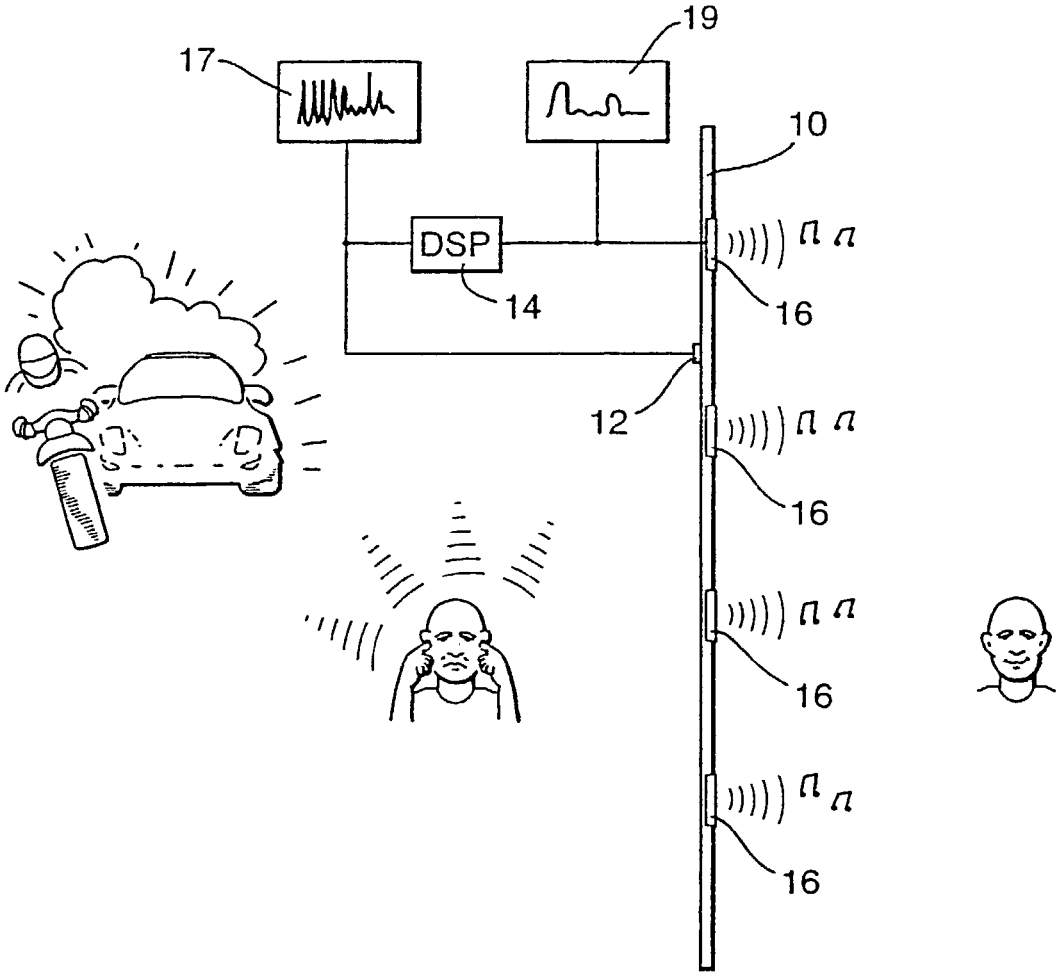
FIG. 4 is a schematic diagram of a first embodiment of the invention.

A first embodiment of the present invention will now be described with reference to FIGS. 4 to 14. As shown in FIG. 4, in this first embodiment, the microphones 12 and the loudspeakers 16 are both mounted on the curtain 10 itself. Otherwise this embodiment is as described in relation to FIG. 1, like parts being designated by the same reference numerals.

Figure 5:
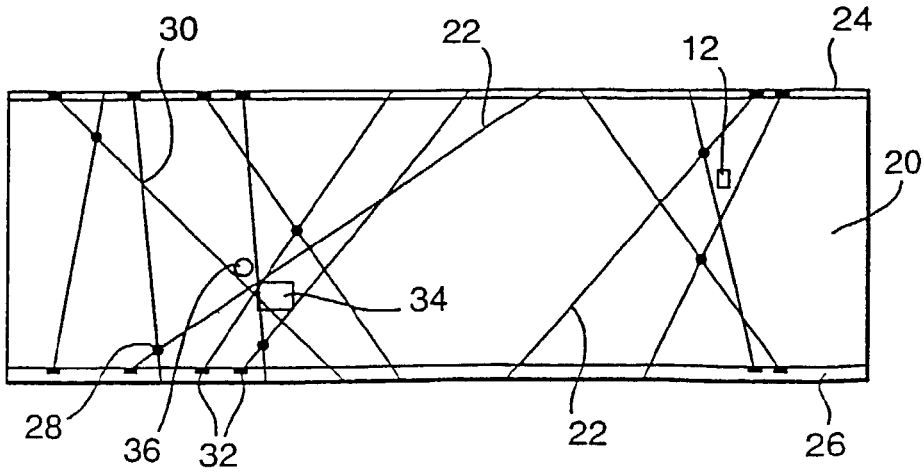
FIG. 5 shows a curtain module employed in the embodiment of FIG. 4.

FIG. 5 illustrates a curtain module 20, which may constitute the whole of the curtain 10 or which, as in the present instance, may simply form a portion of the curtain 10. The curtain module 20 is formed from a flexible rubber material and has molded within it a plurality of electrical wires 22, each extending from an upper edge 24 of the module 20 to a lower edge 26 of the module 20. The wires 22 cross one another respectively at nodes 28 where the wires are electrically interconnected and at intersections 30 where the associated wires remain electrically isolated. At the upper and lower edges 24, 26 of the curtain module, certain of the wires 22 terminate respectively in connectors 32 by which they may be electrically connected to wires in adjacent curtain modules.

Figure 6:
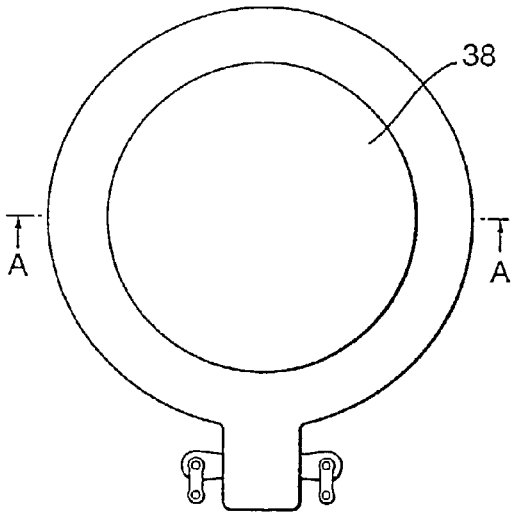
FIG. 6 is a plan view of an exciter or vibrator mounted on the curtain module of FIG. 5.
Figure 7:
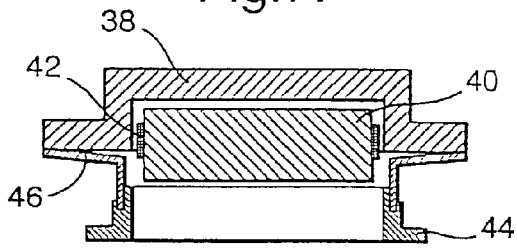
FIG. 7 is a cross-sectional view along the line AA in FIG. 6.

In addition to the wires 22, the curtain module 20 also carries a respective microphone 12 and a respective loudspeaker 16 in the form of a power amplifier 34 and an exciter or vibrator 36. The exciter 36, which is mounted on a stiffened portion of the material of the curtain module 20, is shown in FIG. 6 and FIG. 7. As shown, the exciter comprises a cup-shaped housing 38 containing a core 40 and an excitation coil 42. The housing 38 is arranged to be mounted on the stiffened portion of the curtain module 20 by way of a rigid annular ring 44, which is connected to the rim of the cup-shaped housing 38 by means of a resiliently flexible angled washer 46. When the coil 42 is excited, the core 40 vibrates to cause the stiffened portion of the curtain module 20 to vibrate at an acoustic frequency. More particularly, the annular ring 44 may be attached onto the stiffened portion of the curtain module 20 via superglue or any other conventional means, the identification and implementation of which is apparent to one of skill in the art, so that when the core 40 vibrates the stiffened portion is subjected to pressure waves in the audible range.

The following is a description of how the curtain module may be manufactured relatively cheaply by molding a synthetic rubber material:

a) Rotational molding: In this case, polyurethane (PU) rubber is poured into a rotating drum which spins and also applies heat to the PU rubber. This procedure produces sheets of substantially constant thickness, but has a limitation in the size of the PU sheet, which is restricted by the size of the drum (the biggest sheet found in a U.K. manufacturer was 2400 mm long by 900 mm wide).

b) Sheet molding: A lump of PU rubber of nearly the weight required to fill a flat mold is set on the center of the mold in a semi-solid state, before being vulcanized. A steel tool presses the PU rubber to close the mold letting the PU rubber escape from certain outlets. Heat is applied and the PU rubber sets. The advantage of this procedure is that both sides of the PU sheet can be textured and can also have extruded characteristics (as opposed to only one part of the sheet being textured in the rotational molding process). The obvious disadvantage is the fact that the bigger the size of the sheet to be cast, the higher the cost of the tool.

Figure 8:
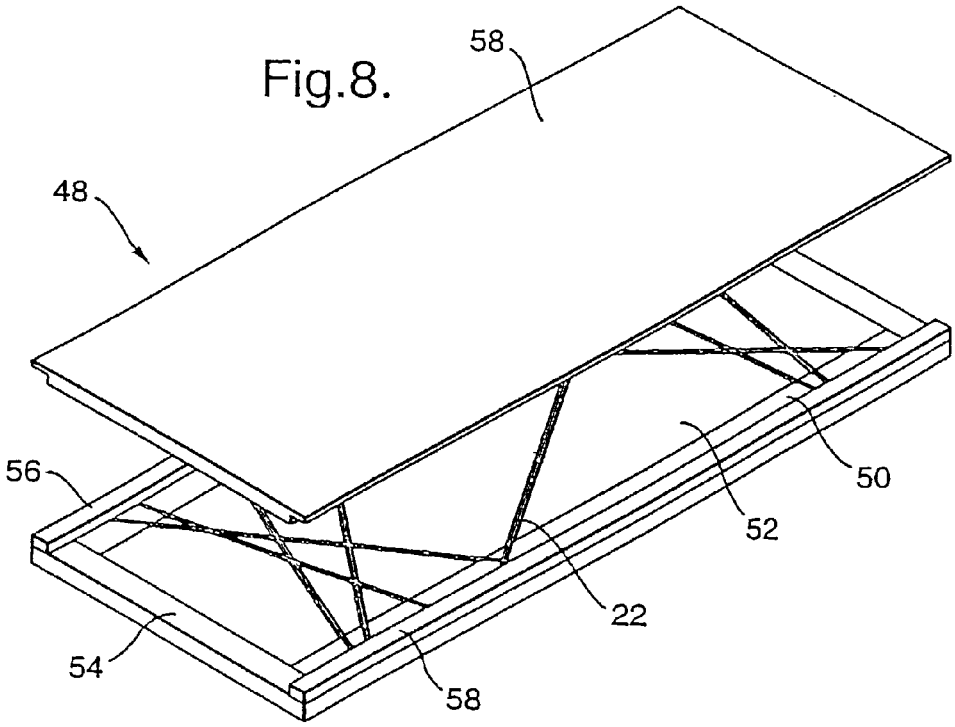
FIG. 8 is a perspective view of a mold for producing the curtain module of FIG. 5.

FIG. 8 shows a specific mold 48 for producing the curtain module 20 of FIG. 5. The mold 48 comprises a lower mold part 50 containing a well 52 for receiving a liquid to be molded. The well 52 is surrounded by a spacer 54 on which a network of flat braided copper wires for forming the wires 22 are supported and held by way of two longitudinally extending clamps 56, 58. The copper wires serve not only for providing the wires 22 in the finished curtain module 20 but also to reinforce the PU sheet and inhibit tensile elongation under load without restricting the flexibility of the molded sheet. The mold 48 also comprises an upper mold part 58 for lowering on to and closing the first mold part 50 during molding.

In the present instance, a transparent two-part polyurethane (PU) rubber compound is employed in the molding process. The compound is mixed as a liquid, passed through a vacuum chamber to be degassed, and then poured into the lower part 50 of the mold 48 and spread by means of aluminum straps (not shown) spanning the full width of the mold in order to obtain an even thickness. The mold 48 is then closed for molding.

A "spark" or sandblasted finish may be applied to an inner surface of the mold to render the sheet translucent instead of transparent and/or to produce desired visual qualities. The polyurethane employed in the compound may if desired be pigmented to generate different colors in selected areas of the curtain module 20 to produce aesthetic designs. The liquid compound employed in the molding process may also be modified with fire retardant for enhancing safety. Ultraviolet stabilizers may also be added.

In an alternative embodiment, wires 22 are integrated into curtain module 20 in such a way that the wires 22 can not be seen.

In order to produce stiffened portions in the material of the curtain module 20 to provide structural areas for carrying the various electrical components, a number of different approaches are possible. For example, hardeners can be added to selected regions of the fluid compound prior to or during molding, or such regions can be cured or heat treated or resin may be applied following molding. Alternatively, stiffened panels may be applied to the mold prior to introduction of the polyurethane compound, or polyurethane compounds of different hardness can be molded together by means of a double molding process. Another possibility is for the curtain to be formed from two or more layers of polyester or Mylar™ screen printed with the conductive pathways and layered together to incorporate rigid panels between them.

Figure 9:
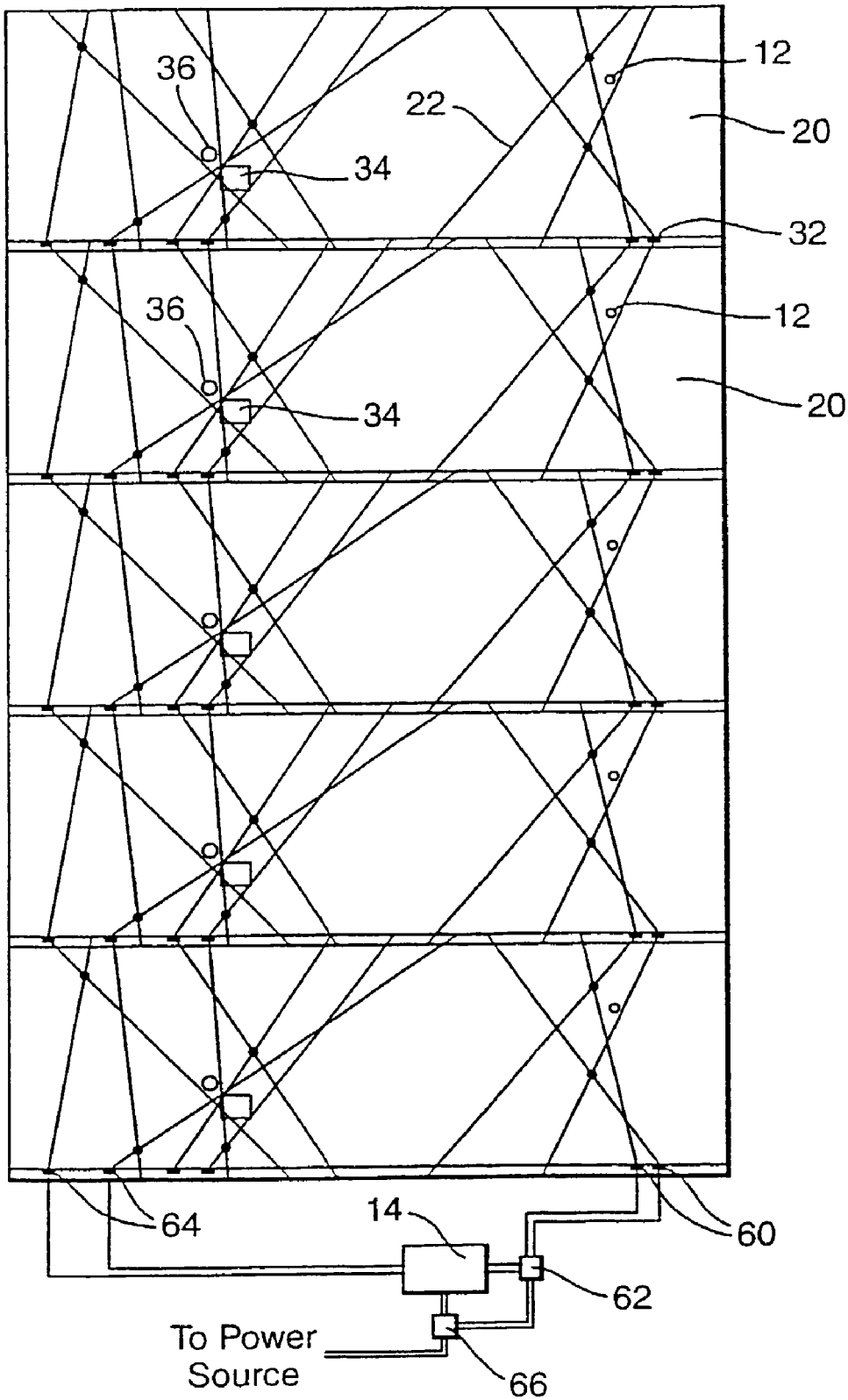
FIG. 9 shows a plurality of the curtain modules of FIG. 5 connected together to form a curtain.
Figure 10:
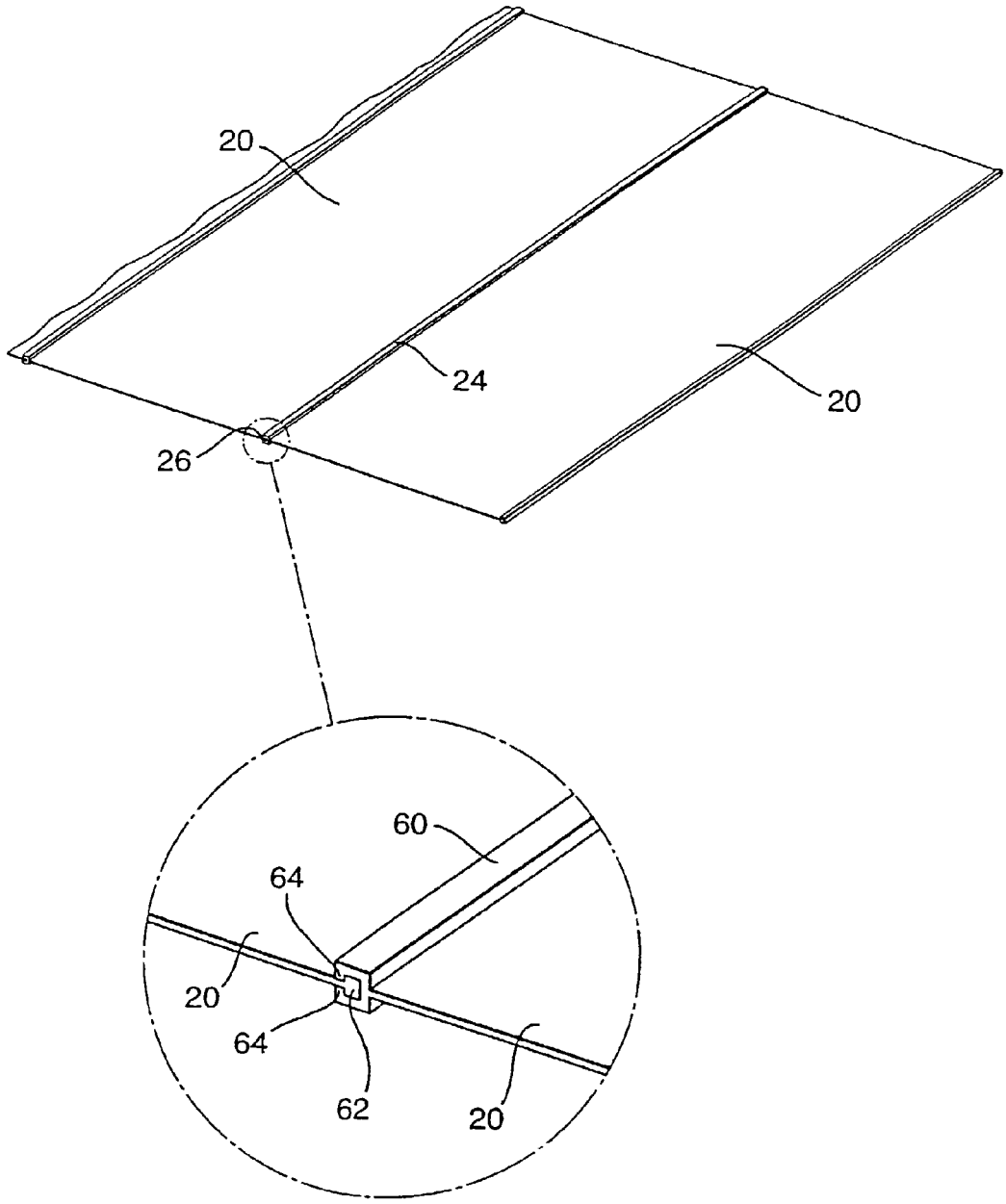
FIG. 10 is a perspective view showing how the edges of respective curtain modules are mechanically connected together.

FIG. 9 shows a plurality of the curtain modules 20 connected together to form the curtain 10. Adjacent modules are mechanically connected together along their respective upper and lower edges 24, 26 by means of a connection as shown in FIG. 10, in which the upper edge 24 of one module 20 is formed with a channel 60 for receiving a rib 62 along the lower edge 26 of the adjacent module 20. The rib 62 is slotted into the channel 60 during assembly and is subsequently held in place by means of a pair of flanges 64 flanking the opening of the channel 60. In another embodiment of the invention, adjacent modules are connected together by conventional attaching techniques, the identification and implementation of which are apparent to one of skill in the art.

Respective wires 22 of each curtain module 20 are electrically inter-connected by way of the connectors 32 to respective wires 22 of the adjacent curtain module 20. It will be seen from FIG. 9 that not all of the wires 22 are so connected but that the arrangement of the connection nodes 28 and connectors 32 is such that at the foot of the curtain 10 there are provided first and second pairs of connectors 60, 64. The first pair of connectors 60 serve for electrically coupling the microphones 12 to a microphone pre-amplifier 62 and thence to the DSP 14. The microphones 12 determine the quality of the input signal, which in turn determines the quality of the transformation and of the output sound, and the provision of a pre-amplifier ensures a good quality signal. The second pair of connectors 64 serve for electrically coupling the exciters 36 and power amplifiers 34 to the DSP 14. A power supply 66, for example a lithium battery, connected to a power source (not shown) supplies power to all of the different circuit elements.

Figure 11:
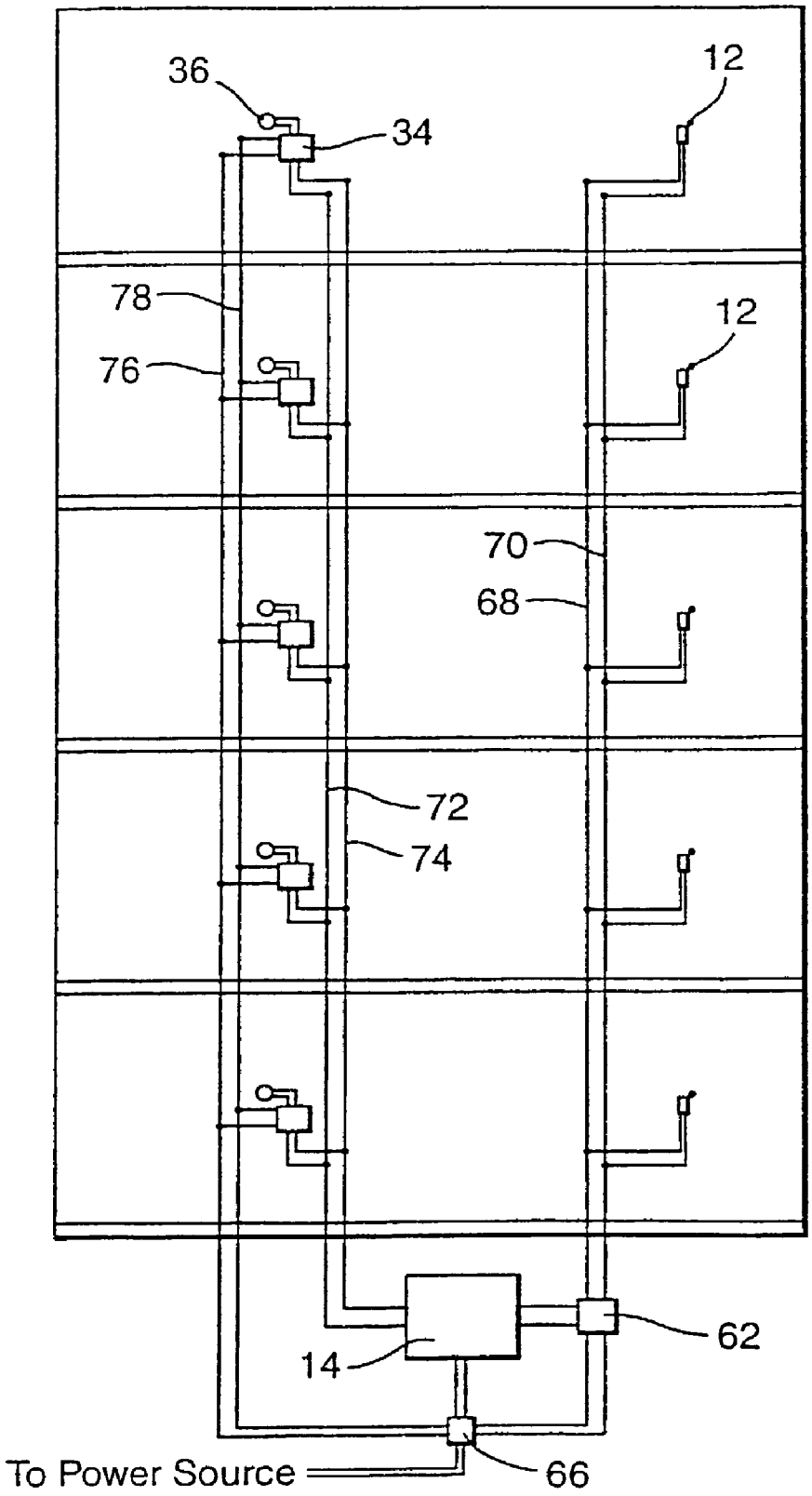
FIG. 11 is a block circuit diagram representing the electrical circuitry employed in the present invention.

FIG. 11 shows the electrical circuitry for the curtain 10 more clearly. As shown in FIG. 11, each microphone 12 is connected between a pair of lines 68, 70 so that the microphones 12 are all connected in parallel. The lines 68, 70 are connected to the microphone pre-amplifier 62 and the DSP 14 to supply the electrical signals from the microphones 12 to the DSP 14 as an input. A pair of lines 72, 74 lead from the DSP 14 to supply an output signal to the power amplifiers 34 and exciters 36. As before, each power amplifier 34 and associated exciter 36 is connected between the lines 72, 74 so that the exciters 36 are all arranged in parallel. A further pair of lines 76, 78 leading from the power supply 66 serve for supplying power to the power amplifiers 34.

The DSP 14 serves to transform the electrical signals supplied from the microphones 12 into modified electrical signals for driving the exciters 36. For this purpose, the DSP 14 employs an algorithm programmed in, for example, but not limited to Opcode MAX/MSP software, which is available in Macintosh™ computers. The DSP 14 implements a series of digital filters arranged to be active one at a time. Each digital filter comprises a number of bandpass filters, one of which has a low center frequency and the others of which have frequencies which are multiples of this base frequency. A graphical interface is provided for a user to facilitate tuning of the parameters of each filtering function, and the algorithm is programmed to make decisions in order to change the filtering function according to the incoming noise signal.

The algorithm serves firstly to adjust the output level in order to modify or not modify peaks of the input noise signal. When sound incidents are happening, the output signal is increased to mask them. In this case, it is preferable for the overall sound energy for the controlled environment to increase, because that decreases the effect of noise disturbance caused to the brain. The same effect is achieved by producing a steady tone, like a constant hum, so as to concentrate on something when somebody is speaking. The algorithm serves secondly to adjust the filtering according to the quality of the incoming noise signal. This feature involves pattern recognition embedded in the software and enables the software to distinguish speech from traffic noise and thereby to adjust the filtering.

The sound transformation is based on principles derived from the psychology of hearing and the study of the human auditory perception. On the one hand, the algorithm is based on masking principles, which are well documented in the science of auditory perception. This effect relates to the incapability of the human auditory system to perceive certain sounds [the maskee sounds] in the presence of other sounds [the masker sounds] with a specific frequency and amplitude relationship.

The frequency and amplitude content of the filtered output are such that the filtered signal can mask the noise signal, thus rendering parts of the noise spectrum inaudible. The achieved masking weakens the "sound identity" of certain disturbing sound events, which become unrecognizable, and therefore does not bring any unpleasant connotations to the user.

Furthermore, the algorithm output is built on known principles of the human auditory system that relate to the grouping of sound events. The close relation between the sensed and the transformed signals ensures that the two are grouped together by the listeners auditory system and are perceived as the new sound environment in the space, which is generated by the co-existence of the environmental noise and the harmonic output. This, in effect the algorithm redefines the sound context into which noise events are experienced and groups unpleasant sound events with more pleasing sounds with aesthetic content favorable to the user.

Another important aspect relates to the effects of noise that are associated with control. The algorithm provides the user with a way to tune their sound environment by exercising an increased level of control on how the new sound environment is generated. This alleviates the disturbance and noise related stress associated with the lack of control.

Figure 12:
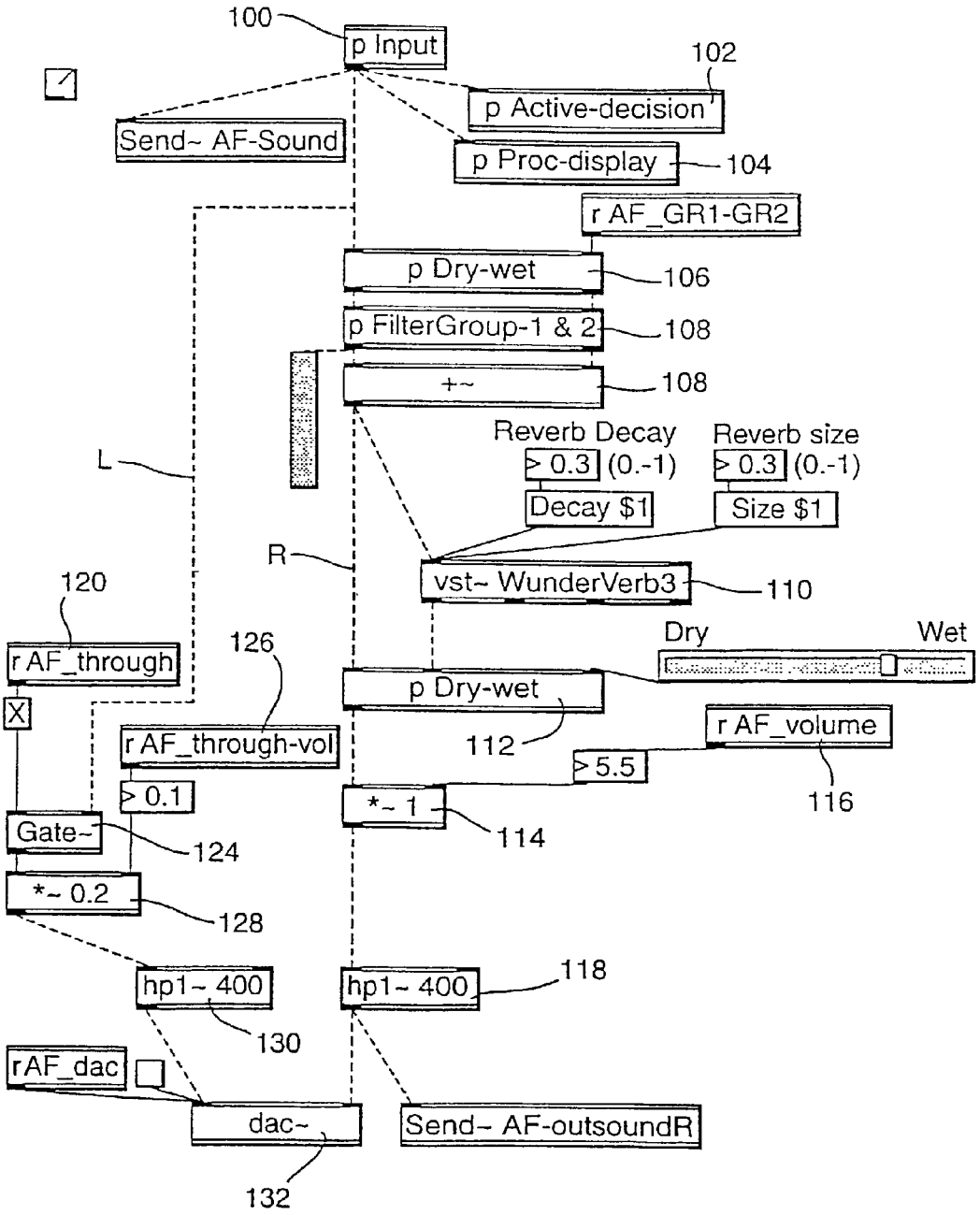
FIGS. 12-14 are flow diagrams representing an algorithm employed in the electrical circuit of FIG. 11.
Figure 13:
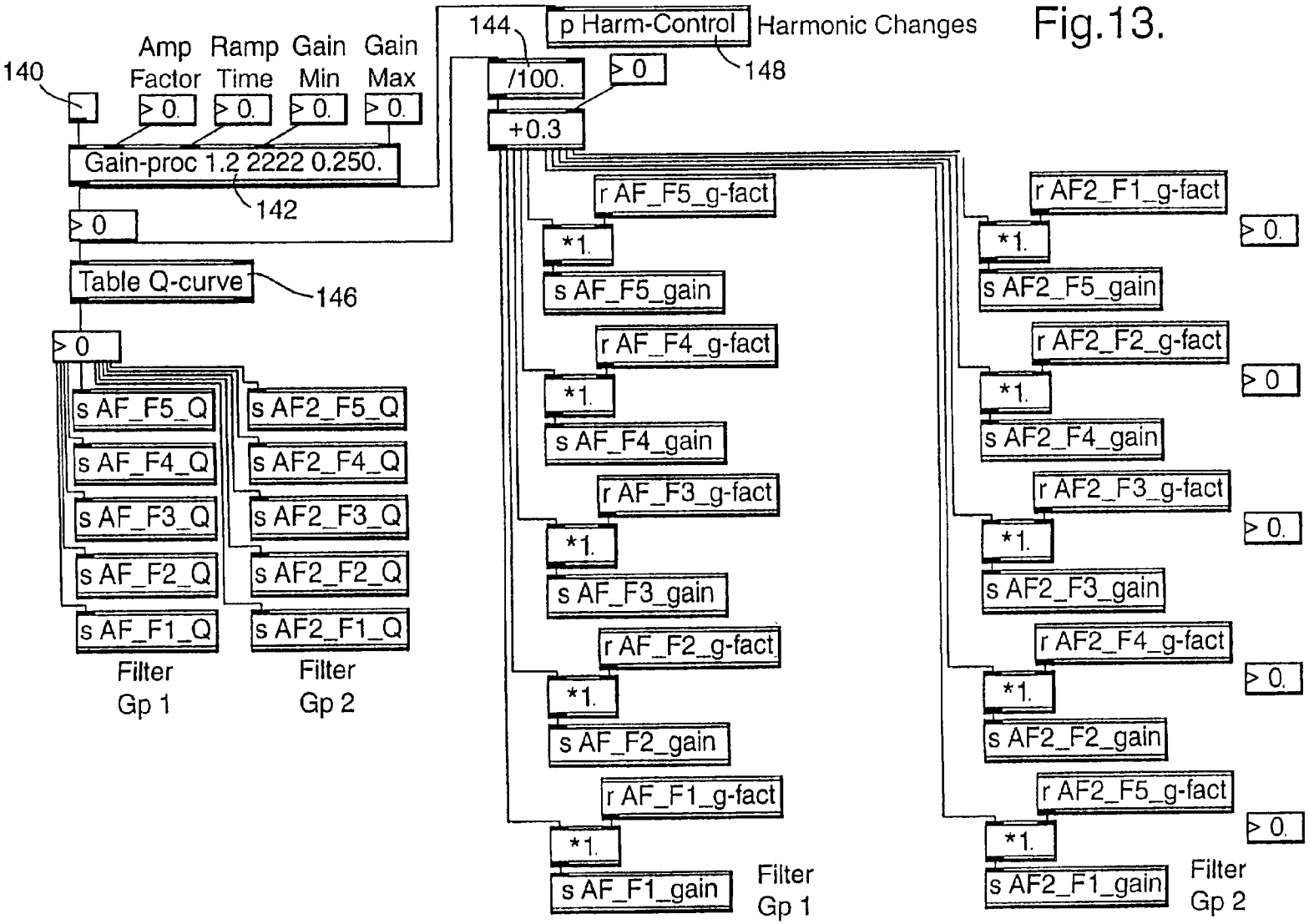
Figure 14:
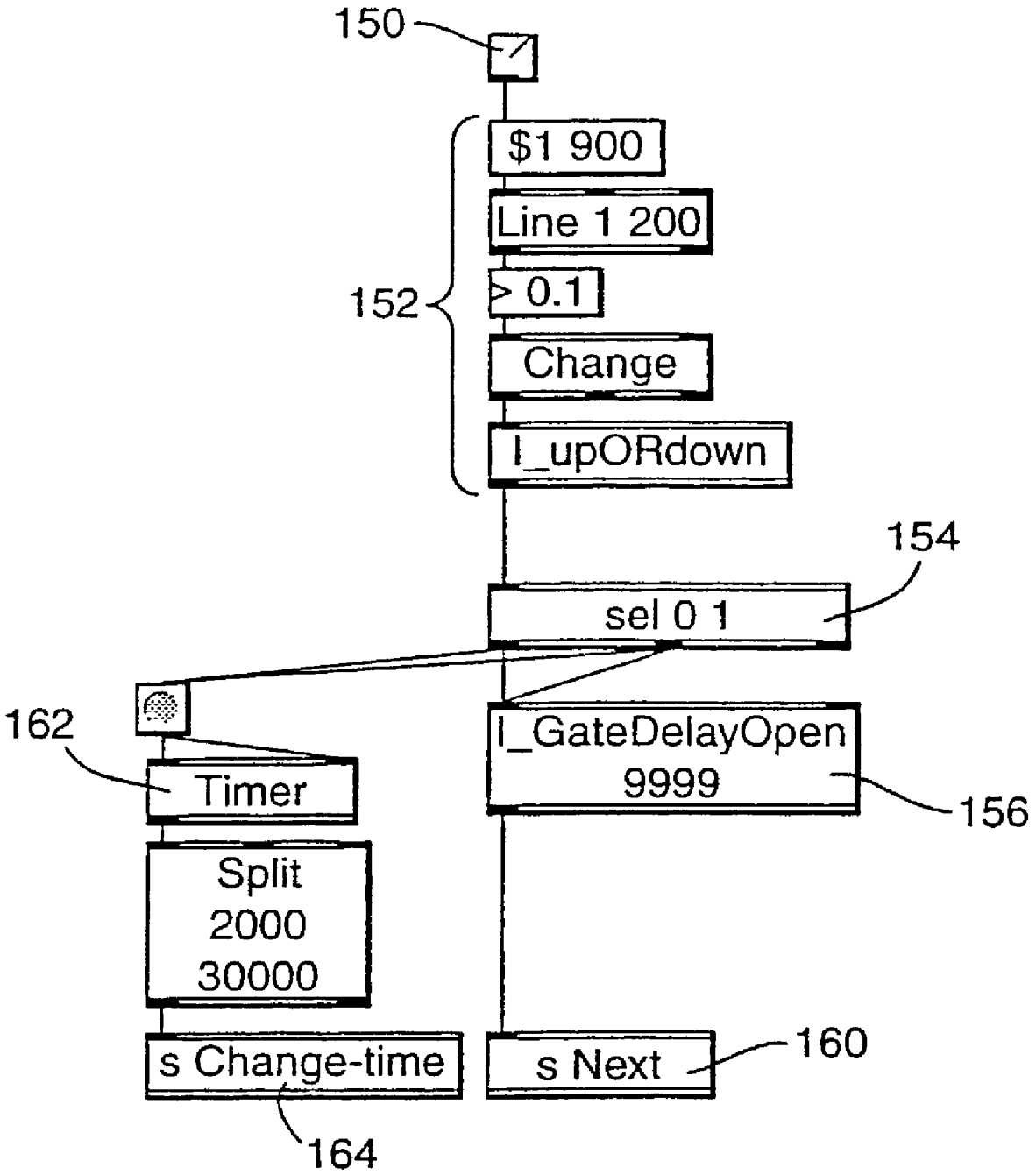

The algorithm will now be described in greater detail with reference to FIGS. 12-14, and to FIGS. 22-25. FIGS. 12-14 represent flow diagrams showing the steps involved in the algorithm. FIGS. 22-25 represent corresponding circuit blocks. For ease of understanding, the latter figures are designated by the same reference numerals with the suffice 'a' added.

Referring to FIG. 12, the noise received by each microphone 12 is converted to a digital electrical signal in an A/D converter (not shown) and is supplied as an input 100. The input is passed to an active decision sub-routine 102 illustrated in FIG. 13 for analysis, and parameters of the input are extracted for subsequent use. Details of the subroutine 102 are displayed in a display in step 104. The signal provided by the input 100 is then passed though a first series of stages L for recreating the ambient sound environment and through a second series of stages R for generating a musical output.

The first stages of R will be described first.

In step 106, a ratio for the relative output level of the two filter groups is determined and is set. The input signal 100 is then supplied in step 108 to two groups 1 and 2 of five filters: the steepness (q-factor) and the gain of each filter are automatically adjusted, as described below, according to the criteria in sub-routine 102. The center frequencies $F_0$ to $F_5$ of the five filters of each filter group are arranged to have a harmonic relation to one another. The center frequencies are selected within the algorithm by first selecting a base frequency, which is the center frequency of the first filter, and the multiplying this value by four numbers that correspond to a chord. For each selected frequency, there is identified a set of possible chords that the algorithm may use, determined by the programmer/composer. In this way, the tonal possibilities of the system can be controlled to achieve the desired aesthetic result.

In an embodiment of the invention, exemplary chords used in the algorithm are as follows [chord name followed by 4 multipliers, one for each filter center frequency]: Fifth, 7 12 14 24; Octave, 12 24 36 48; Fifth_Through, 7 14 21 28; Major_Triad, 4 7 12 16; Major_Extended, 7 12 16 24; Minor_Triad, 3 7 12 15; Minor_Extended, 7 12 15 24; Major7, 4 7 11 16; Maj7th_3rd, 3 7 11 15; Minor7, 3 7 10 15; Dominant7, 4 7 10 16; Dom7_Sus4, 5 7 10 17; Dom7_Flat5, 4 6 10 16; Dom7_Flat9, 7 10 13 16; Dom7_Aug9, 4 10 15 24; Dom7_Alt9, 4 8 10 15; Dom7_Aug11, 10 16 18 24; Augmented, 4 8 12 16; Dim7_Closed, 3 6 9 12; Dim7_Open, 15 24; Sixth, 4 7 9 12; Minor_Sixth, 3 7 9 12; Sixth_Add9, 4 7 9 14; Dominant9, 4 7 10 14; Major9, 4 7 11 14; Minor9th, 3 7 10 14; Dom9_Sus4, 10 14 17 24; Dom9_Aug5, 4 8 10 14; Dom9_Flat5, 4 6 10 14; Dom9_Flat13, 10 14 16 20; Thirteenth, 10 14 16 21; and Thirteenth_Flat9, 10 13 16 21. For instance, for a base frequency of 60 Hz and a Major_Triad selected, the center frequencies of the 5 filters of one filter group would be 60 Hz, 240 Hz, 420 Hz, 720 Hz, and 960 Hz. The sequences corresponding to the two filter groups can have the same or a different amount of members to produce a fixed or a virtually indefinite number of possible harmonic transitions when transitions between the two filter groups occur.

The signal output from the two groups 1 and 2 of filters in step 108 is passed in step 110 to further filters for adding reverberation and echo frequencies, and this signal is mixed back in with the output of the two groups 1 and 2 of filters in step 112.

The resultant signal has its amplitude controlled in step 114 according to a predetermined level set by the user in step 116. Finally, the signal is passed in step 118 through a high pass filter for output in step 132.

In the series of stages L, the signal from the output 100 is passed through a control step 120 in which it is determined whether the original noise is to be heard in the output or not. If not, the input signal is filtered out in step 124. If it is, the signal is passed through a gate in step 124. The determination in step 120 is effected by the user by way of manual control and, if the user indicates that the original noise is to be heard, then they will also set a level of control in step 126. The signal output from the gate in step 124 is then controlled to the desired level in step 128 according to the predetermined amount set in step 126. Finally, the resultant signal is passed through another high pass filter in step 130 for output in step 132.

The signals obtained in steps 118 and 130 are combined in step 132 and are passed through a D/A converter to supply to the amplifiers to drive the exciters 36.

The active decision sub-routine 102 will now be described with reference to FIG. 13. Firstly, the input signal from step 100 is supplied to a sub-routine input 140. This input is analyzed in step 142 within five frequency bands for evaluating the amplitude required for each of the five filters in the two filter groups 1 and 2. For example, the mean amplitude of the sensed input in each of the five frequency bands is computed as defined by the center frequencies specified by the harmonic progression for a frequency band of a given width, which may be set by trial and error. Following this analysis, a control output is supplied in step 144 for setting the gain of each of the five filters in the two filter groups 1 and 2. The control output is also supplied in step 146 to a circuit for setting the steepness or q-factor in each of the filter groups 1 and 2. For example, step 146 can be a simple curve that defines that the steepness of each filter is conversely proportional to the gain, i.e., when the gain is high, the steepness is low.

If desired, a further control may be imposed on the control output through a harm control sub-routine 148, which is illustrated in FIG. 14. This sub-routine monitors the input signal to trigger a change of one filter group to the other in certain circumstances as described below.

Referring to FIG. 14, the input signal from step 140 is supplied to a harm control input 150 and passed through a series of steps 152 in order to detect peaks in the input noise signal. In response to such peaks, the harm control sub-routine triggers in step 154 a change-over command. The trigger command 160 is supplied to the filter group weighting subroutine 106 that cross fades between the two filter groups by adjusting their respective amplitudes over the time specified in step 164. The timing of the trigger commands is monitored in step 162 and adjusted in step 164 if it is considered to be too rapid.

Turning now to FIGS. 22 to 25, the electrical circuitry for performing the algorithm will be described.

Figure 22:
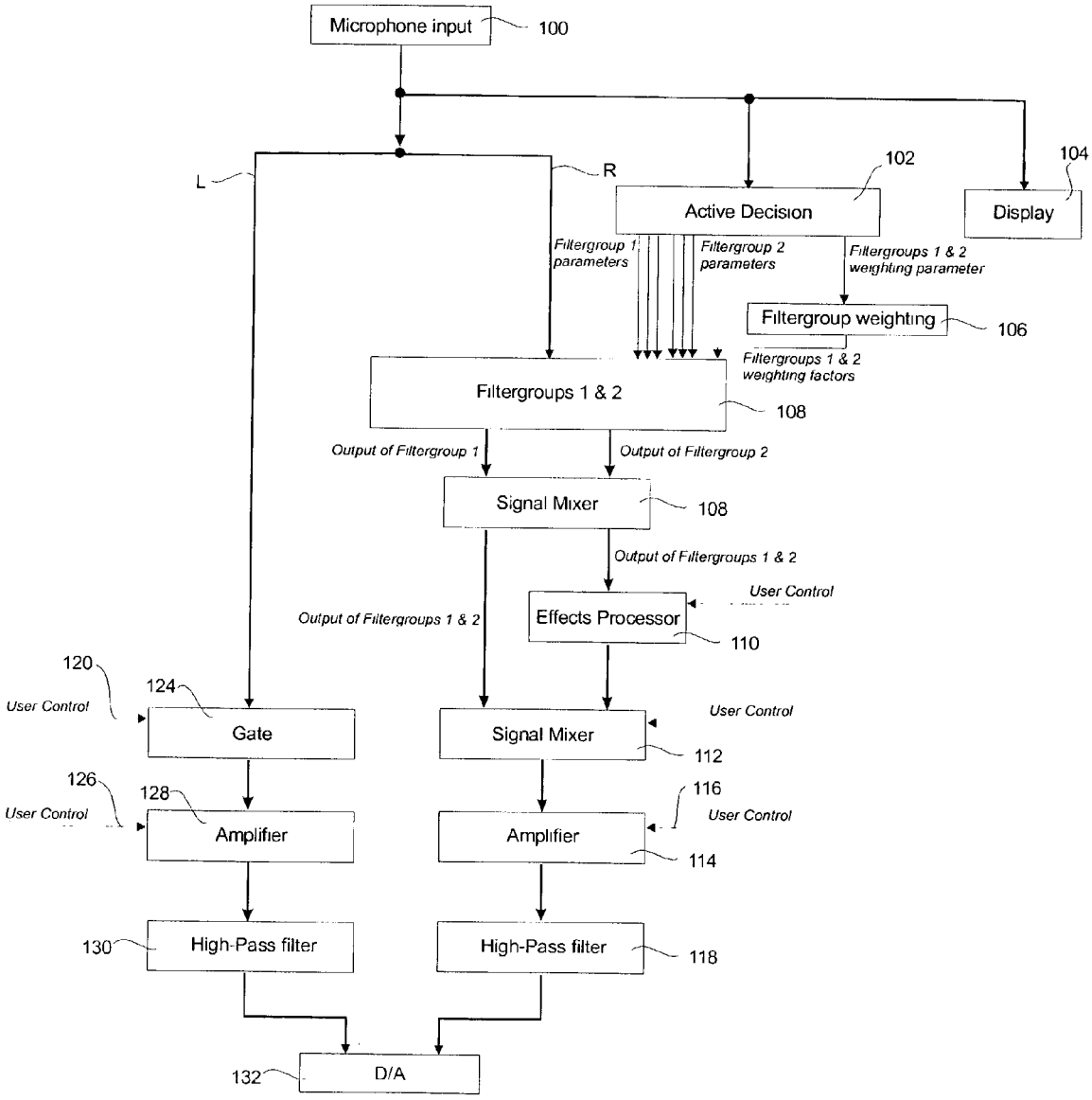

Referring to FIG. 22, the noise received by each microphone 12 is converted to a digital electrical signal in an A/D converter (not shown) and is supplied as an input signal to an input 100*a*. The signal from the input 100*a* is passed to a circuit 102*a* illustrated in FIG. 23 for analysis, and parameters of the input signal are extracted for subsequent use. Details of the analysis are displayed on a display 104*a*. The input signal is also passed through a first series of stages L for modifying and outputting the sensed sound and through a second series of stages R for generating a musical output.

The first series of stage R will be described first.

These stages include the groups 1 and 2 of five band-pass filters, designated as filter groups 108*a* in FIG. 22 and FIG. 25, arranged to receive the signal from the input 100*a*. A cross fader 106*a* determines a ratio for the level of original to transformed noise and sets the relative output levels of the two groups 1 and 2 of five filters in the filter groups 108*a* anywhere between 0% for group 1 and 100% for group 2 to 100% for group 1 and 0% for group 2. Furthermore, the steepness (q-factor) and the gain of each filter are automatically adjusted, and the center frequencies $F_0$ to $F_5$ of the five filters of each filter group 1 and 2 are arranged to have a harmonic relation to one another, in dependence upon outputs from the circuit 102*a*, as described below.

The signals output from the two groups 1 and 2 of filters in filter groups 108*a* are mixed in a mixer 108*b* and passed through an effects processor 110*a* for adding reverberation and echo frequencies, and the output from this processor 100*a* is mixed back in with the output of the mixer 108*b* in a further mixer 112*a*.

The resultant signal from the mixer 112*a* is amplified in an amplifier 114*a* whose gain is set to a predetermined level through a user input 116*a*. Finally, the amplified signal is passed through a high pass filter 118*a* to an output D/A converter 132*a*.

In the series of stages L, the signal from the input 100*a* is passed to a gate 124*a* where a user control input 120*a* determines whether the original noise is to be heard in the output or not. If not, the input signal is filtered out at the gate 124*a*. If it is, the signal is passed through the gate 124*a*. The user control input 120*a* is effected by the user by way of a manual control and, if the user indicates that the original noise is to be heard, then they will also set a level of control applied as a user control input 126*a* to an amplifier 128*a*. The signal output from the gate 124*a* is then amplified to the desired level in amplifier 128*a* according to the control input 126*a*. Finally, the resultant signal is passed through another high pass filter 130*a* for output by the D/A converter 132*a*.

The signals from the high pass filters 118*a* and 130*a* are combined in the D/A converter and are supplied to the amplifiers 34 to drive the exciters 36.

Figure 23:
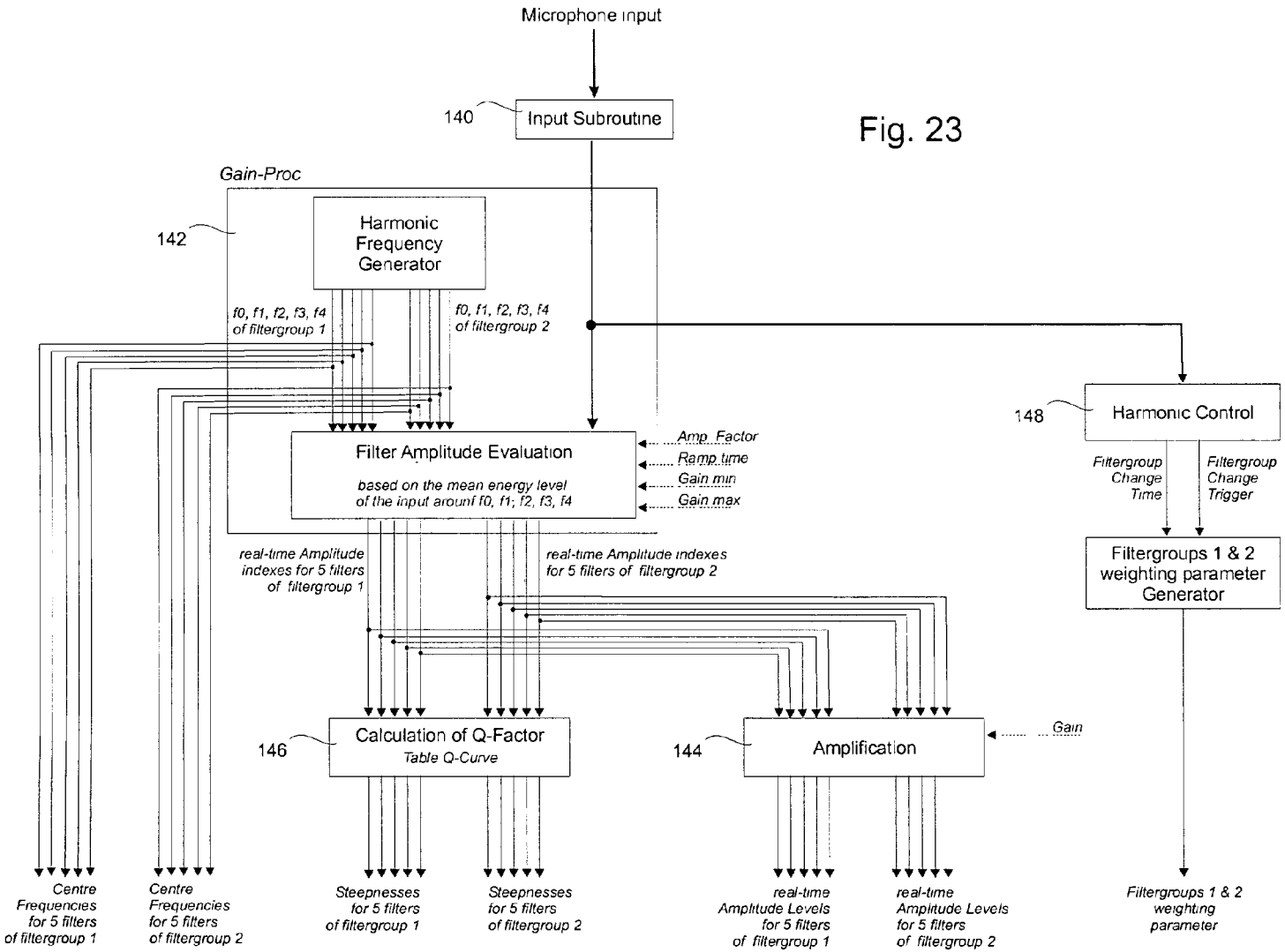

The analysis circuit 102*a* will now be described in further detail with reference to FIG. 23. Firstly, the input signal from the input 100*a* is supplied to a sub-routine input 140*a* and thence to a processor 142*a*, comprising an harmonic frequency generator 242 and a filter amplitude evaluator 244. The harmonic frequency generator 242 is arranged to select a respective base frequency for each group 1 and 2 of five filters, and to set this frequency as the center frequency for the first filter in the associated group. The harmonic frequency generator 242 then identifies four further frequencies representing multiples of the respective base frequency corresponding to a chord, and sets this set as the center frequencies for the second to fifth filters in the associated group. Outputs from the harmonic frequency generator 242 are applied directly to the filter groups 108*a* and also to the filter amplitude evaluator 244.

The filter amplitude evaluator 244 is arranged to receive the input signal from the input 140*a* and to compute the mean amplitude of the sensed input in each of five frequency bands determined according to the center frequencies output by the harmonic frequency generator 242 and according to a band width set by a control input 244*a*.

Following the analysis, the filter amplitude evaluator 244 supplies, as an output from the processor 142*a*, a control output which is passed firstly to an amplifier 144*a* and secondly to a setting circuit 146*a*. The output from the amplifier 144*a* serves to set the gain of each of the five filters in the two filter groups 1 and 2. The circuit 146*a* is arranged to supply an output for setting the steepness or q-factor in each of the filter groups 1 and 2, for example on the basis of a simple function defining the steepness of each filter as inversely proportional to the gain.

If desired, a further control may be imposed on the signal supplied to the filter groups 108*a* through a harm control circuit 148*a*, which is arranged to receive the signal from the input 140*a* and is illustrated in FIG. 24. This circuit 148*a* monitors the input signal to trigger a change from one filter group to the other in certain circumstances as described below.

Referring to FIG. 24, a control output from the processor 142*a* is supplied to a harm control input 150 and passed through a peak detection mechanism 152*a* in order to detect peaks in the input noise signal. In response to such peaks, the circuit 152*a* activates a trigger generator 154*a*, 156*a* to generate a change-over command 160 to effect a change between the two filter groups 1 and 2. The timing of the trigger is monitored in a timing circuit 162*a* and adjusted by an output 164*a* if it is considered to be too rapid.

Figure 15:
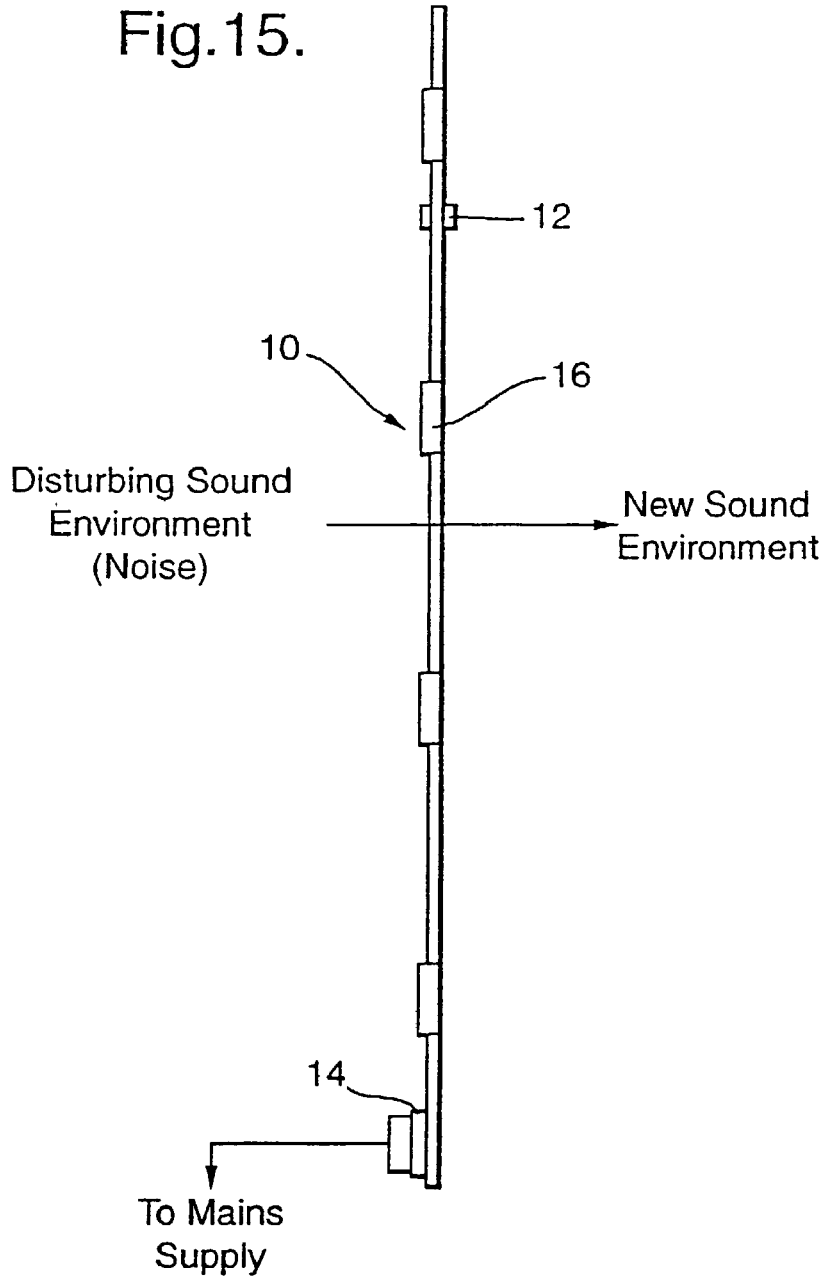
FIG. 15 is a schematic diagram of a second embodiment of the present invention.

A second embodiment of the invention will now be described with reference to FIGS. 15-17. This second embodiment constitute a modification of the first embodiment and like parts are designated by the same reference numerals. Only the differences will be described.

In the second embodiment, the microphones 12 are mounted on a portion of the curtain 10, as well as the loudspeakers 16. The DSP 14 and the power supply 66, in the form of a rechargeable battery and/or an AC/DC transformer, are also mounted on the curtain 10.

Figure 16:
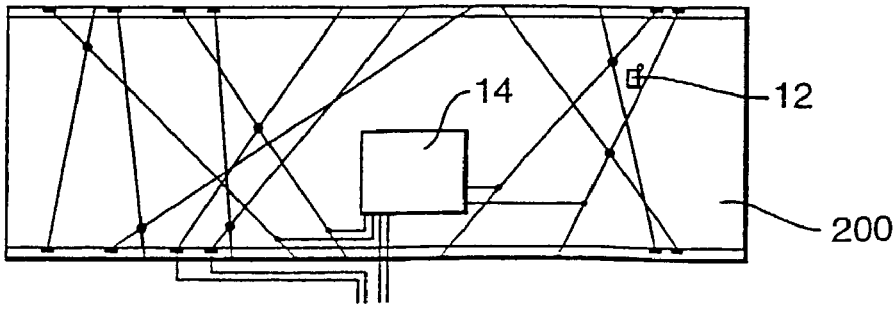
FIG. 16 shows a curtain module employed in the second embodiment of FIG. 15.
Figure 17:
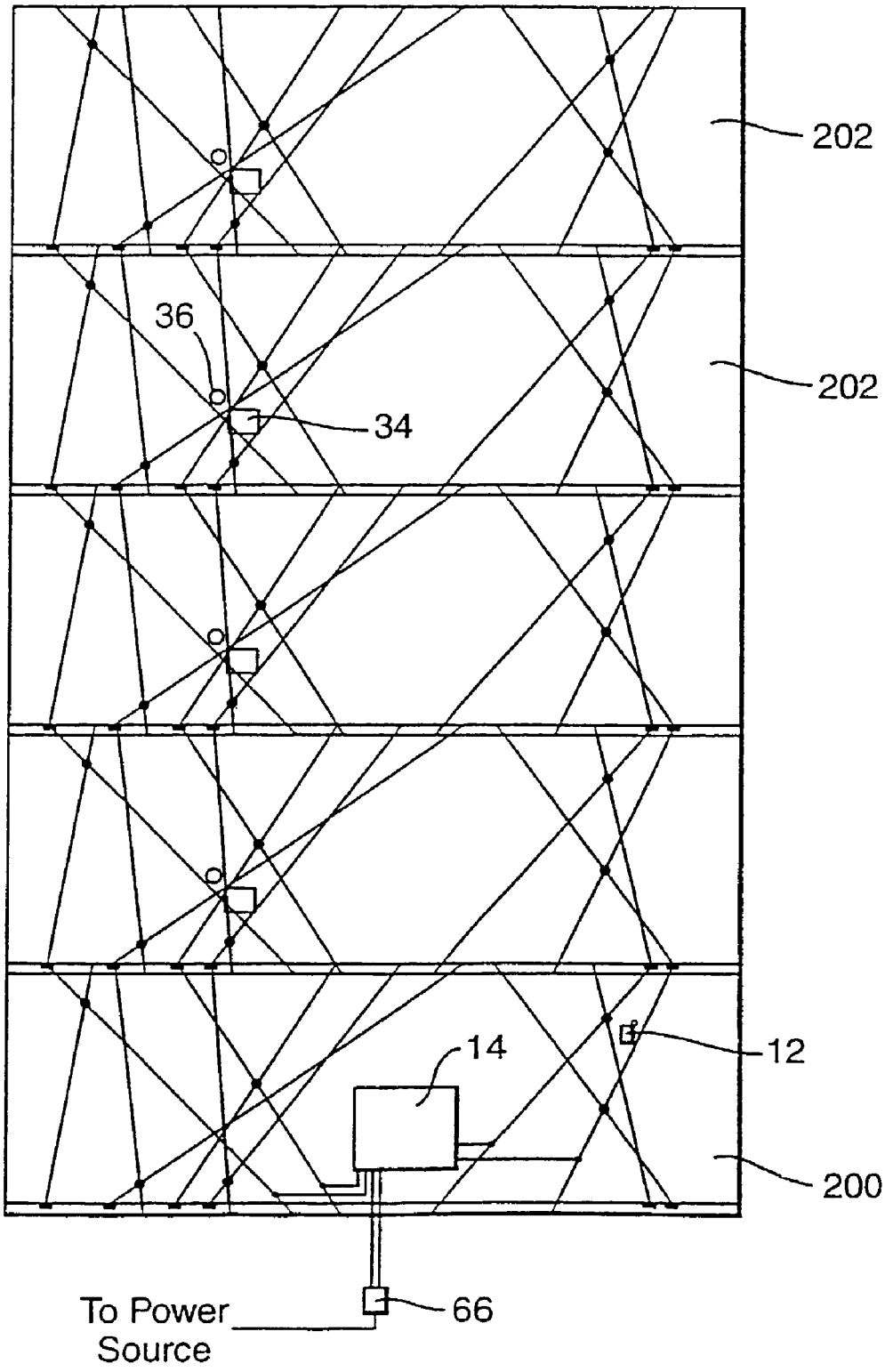
FIG. 17 shows a plurality of curtain modules that are connected together and include the curtain module of FIG. 16.

FIG. 16 shows a curtain module 200 for use in the second embodiment, carrying both a microphone 12 and the DSP 14. As shown in FIG. 17, it is envisaged in the second embodiment that the curtain module 200 will be employed with a further series of curtain modules 202, each bearing only a respective power amplifier 34 and exciter 36 but no further microphone 12.

Figure 18:
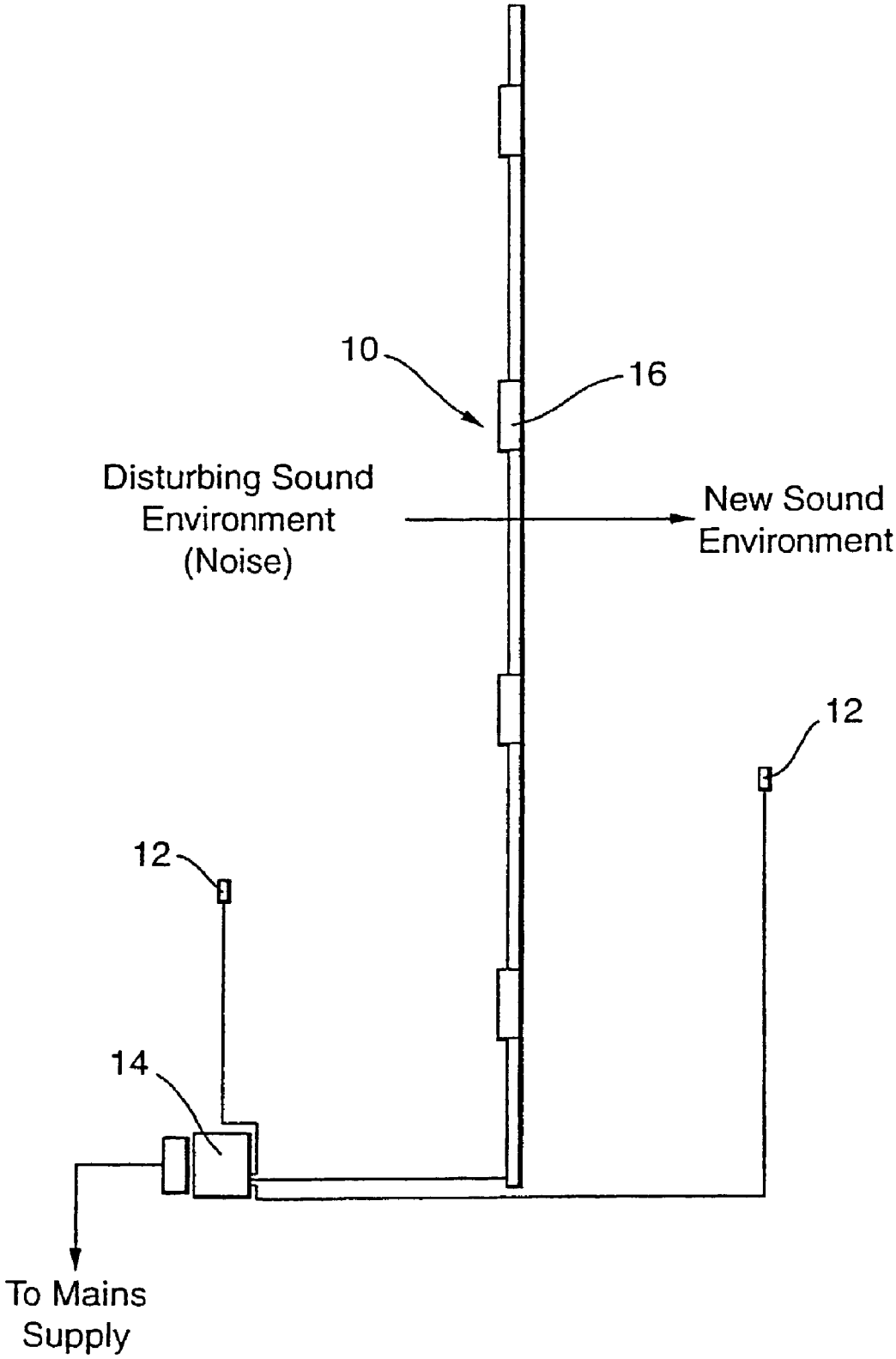
FIG. 18 is a schematic diagram of a third embodiment of the present invention.
Figure 19:
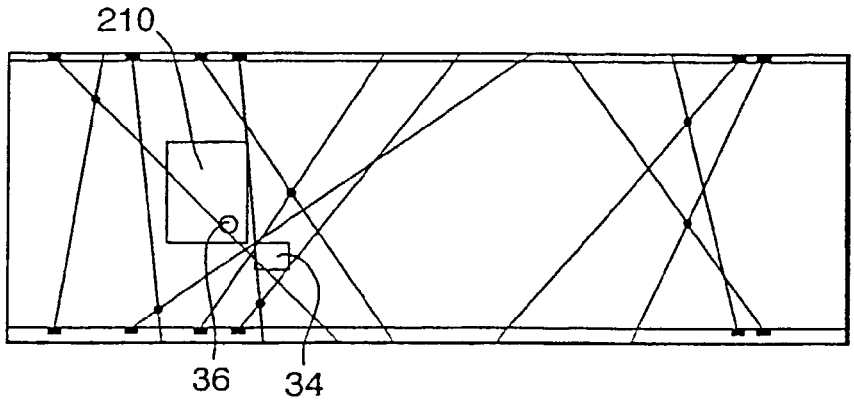
FIG. 19 shows a curtain module employed in the third embodiment of FIG. 18.

A third embodiment of the invention is illustrated in FIG. 18. Again, like parts are designated by the same reference numerals and only the differences in relation to the first embodiment will be described.

In the third embodiment, the microphones 12 and the DSP 14 are spaced at a distance from the curtain 10, and the loudspeakers 16 are mounted on the curtain 10. In this instance, each loudspeaker comprises an exciter 36 mounted on a rigid panel 210, which is inserted into the mold during molding of the curtain 10 or which is produced as a part of the curtain with a double molding process.

Figure 20:
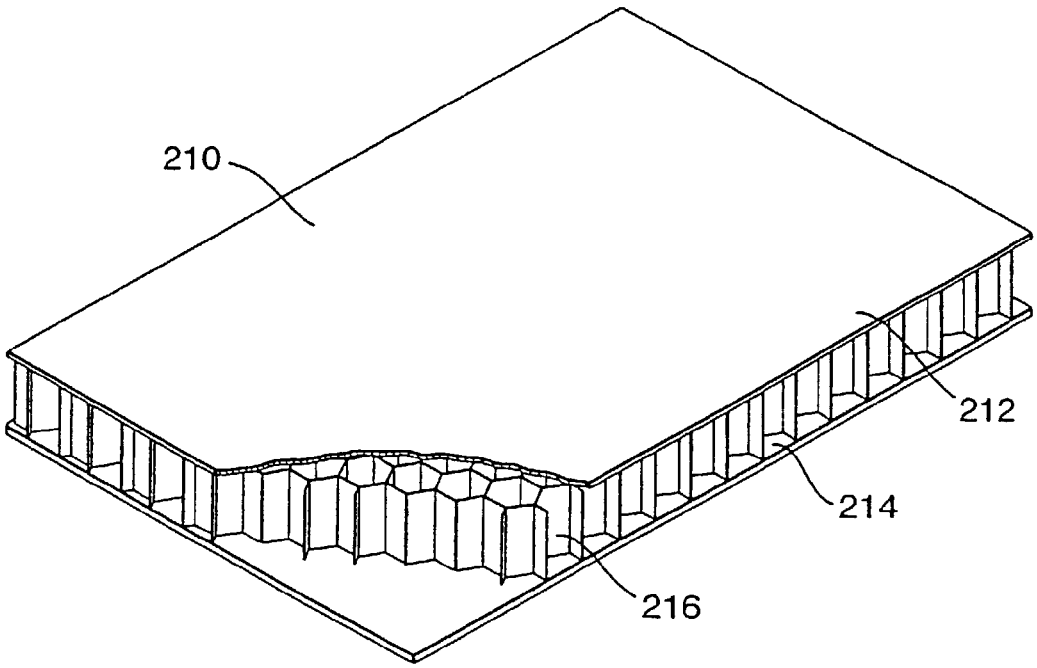
FIG. 20 is a perspective view of a panel employed in the curtain module of FIG. 19.

One possible form of the rigid panel 210 is illustrated in FIG. 20 and comprises first and second skins 212, 214 with a honeycomb core 216 mounted between them. The combination of the honeycomb core 216 with the two skins 202, 214 results in a substantially rigid structure providing the panel 201.

Figure 21:
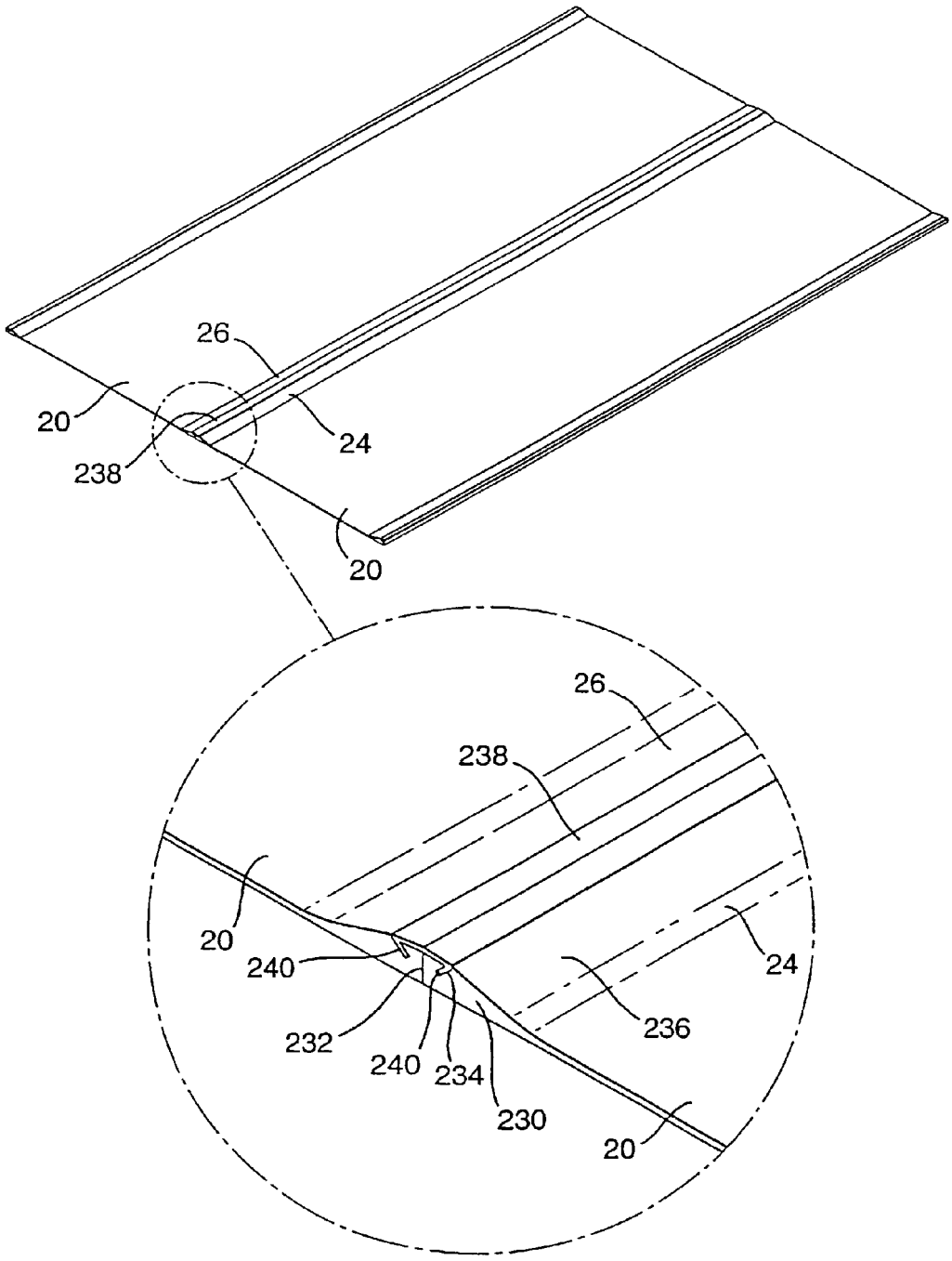
FIG. 21 shows a modification of the mechanical connection shown in FIG. 10 for joining curtain modules together.

Finally, a modification of the connection means illustrated in FIG. 10 for connecting curtain modules together is shown in FIG. 21. According to this modification, the upper and lower edges 24, 26 of each curtain module 20 are formed to be identical and to have a wedge-shaped portion 230 that thickens towards the edge of the curtain module 20. Each wedge shaped portion 230 terminates in a planar surface 232 arranged perpendicular to the main plain of the curtain module 20, and a groove 234 is provided in a side surface 236 of the wedge-shaped portion 230 and extends towards the planar surface 232. An elongate connector strip 238 formed with a pair of converging flanged edges 240 can be slotted into the groove 234 of adjacent curtain modules 20 for joining the curtain modules together.

It will be appreciated that a number of further modifications are possible in the invention as described without departing from the scope of the invention.

In particular, the wiring, and electrical circuit components, may be screen printed on to the surface of the curtain 10, rather than molded in situ as described. Conductive inks are commercially available providing a very flexible, low resistance, screen printable medium. In this instance, the ink may need to be heat Treated for a short time, for example 5 to 15 seconds, at a raised temperature in the range, for example, of 80 to 120 degrees centigrade.

The described exciters 36 may also be replaced by alternative loudspeakers 16, for example, piezo-electric speakers or other small sized flat speaker arrangements. Another possibility is to employ flexible piezo speaker film for the whole surface of the curtain 10, to act as the loudspeaker. The film may be stretched or curved in order to increase output quality.

In the embodiments described above, stiffened portions have been provided in the curtain 10 for mounting the loudspeakers 16. If the curtain material is stiff enough, however, such portions may be omitted altogether for ease of manufacture. Alternatively, if stiffened portions are provided, they may be selected to have a range of stiffnesses as desired.

Furthermore, the panel shown in FIG. 20 and proposed for providing a stiffened curtain portion may alternatively be used in its own right as curtain module or as a partitioning device, since such a construction would be particularly effective at reducing the noise level.

According to the described embodiments of the present invention, ambient noise detected by the microphones 12 is replaced with a particular quality of relaxing, soothing or musical sound. The present invention records environmental sound, applies simple transformations to signals representing the sensed sound using a filtering process, for example by means of digital filters, and provides an output thus based on the received sound. There are many types of filtering arrangements that can be used to achieve such a transformation, including the filter groups described above, the use of delay circuitry or delay lines, and many others, all designed to process and preserve a substantial amount of information from the input sound.

Other embodiments and uses of the invention will be apparent to those skilled in the art from consideration of the specification and practice of the invention disclosed herein. All references cited herein, including all U.S. patents, are hereby incorporated herein by reference in their entirety. Although the invention has been particularly shown and described with reference to several preferred embodiments thereof, it will be understood by those skilled in the art that various changes in form and details may be made therein without departing from the spirit and scope of the invention as defined in the appended claims.

We claim:

1. Apparatus for acoustically improving an environmental space comprising:

passive means for at least one of absorbing and reflecting sound within an environmental space and active means for transforming said sound by building harmonic elements on said sound adjusted to provide masking sound;

the passive means comprising a partitioning screen for producing a discontinuity in a sound conducting medium in the environmental space;

the active means comprising:

means for receiving acoustic energy representing sound from the environmental space and for converting the acoustic energy into an electrical input signal;

means for receiving and analyzing the input signal into a plurality of frequency bands to derive control parameters;

a series of bandpass filters for receiving and filtering the input signal for generating an output, said bandpass filters corresponding in number to the plurality of frequency bands and having center frequencies in a harmonic relation to one another, wherein the control parameters from the means are arranged to set automatically in real time the gain and the steepness of each filter in the series of filters in order to adjust the filtering of each said filter and control the output according to the level and quality of sound within the environmental space, and wherein the thus controlled series of filters are arranged to transform the frequency characteristics of the input signal by building harmonic elements on the received acoustic energy to provide masking sound;

means responsive to the output from the series of filters for generating an electrical output signal; and output means for converting the output signal into masking sound for modifying sound within the environmental space.

2. The apparatus according to claim 1, wherein the partitioning screen comprises a curtain.

3. The apparatus according to claim 2, wherein the curtain is translucent and comprises a woven or molded material.

4. The apparatus according to claim 2, wherein the curtain comprises flexible and inflexible portions.

5. The apparatus according to claim 4, wherein the output means is mounted on the inflexible portions of the curtain.

6. The apparatus according to claim 1, wherein the partitioning means comprises electrically conductive pathways.

7. The apparatus according to claim 6, wherein the electrically conductive pathways are integrally molded within the partitioning screen or are defined by electrically conductive ink printed on the surface thereof.

8. The apparatus according to claim 1, wherein the receiving means is mounted on the partitioning screen.

9. The apparatus according to claim 1, wherein the partitioning screen comprises at least two materials of differing acoustic properties.

10. The apparatus according to claim 9, wherein the materials of differing acoustic properties are separated by a space.

11. The apparatus according to claim 1, wherein the partitioning screen comprises a rigid panel.

12. The apparatus according to claim 1, wherein the means for receiving and analyzing the input signal include a microprocessor or digital signal processor operating under the control of an algorithm.

13. The apparatus according to claim 1, wherein the ambient noise level is reduced by 6 to 12 decibels by means of the partitioning screen and/or the masking sound from the output means of the active means.

14. A method of manufacturing an apparatus for acoustically improving an environmental space, the apparatus comprising:

passive means for at least one of absorbing and reflecting sound within an environmental space and active means for transforming said sound by building harmonic elements on said sound adjusted to provide masking sound;

the passive means comprising a partitioning screen for producing a discontinuity in a sound conducting medium in the environmental space;

the active means comprising:

means for receiving acoustic energy representing sound from the environmental space and for converting the acoustic energy into an electrical input signal;

means for receiving and analyzing the input signal into a plurality of frequency bands to derive control parameters;

a series of bandpass filters for receiving and filtering the input signal for generating an output, said bandpass filters corresponding in number to the plurality of frequency bands having a harmonic relation to one another;

wherein the control parameters from the analyzing means are arranged to set automatically in real tome the gain and the steepness of each said filter in the series of filters in order to adjust the filtering of each said filter and control the output according to the level and quality of sound within the environmental space, and wherein the thus controlled series of filters are arranged to transform the frequency characteristics of the input signal by building harmonic elements on the received acoustic energy to provide masking sound;

means responsive to the output from the series of filters for generating an electrical output signal; and output means for converting the output signal into masking sound for modifying sound within the environmental space;

the method of manufacturing comprising the step of:

providing electrically conductive pathways in or on a flexible material, the electrical pathways being adapted to connect to means for receiving audio energy and for converting such audio energy into an electrical signal for processing and being adapted also to provide a pathway for the processed electrical signal to an audio output means.

15. A system for acoustically improving a sound environment comprising:

passive means for at least one of absorbing and reflecting sound within an environmental space and active means for transforming said sound by building harmonic elements on said sound adjusted to provide masking sound;

the passive means comprising a partitioning screen for producing a discontinuity in a sound conducting medium in the environmental space;

the active means comprising:

means for receiving acoustic energy representing sound from the environmental space and for converting the acoustic energy into an electrical input signal;

means for receiving and analyzing the input signal to derive control parameters;

a series of bandpass filters for receiving and filtering the input signal for generating an output, said bandpass filters corresponding in number to the plurality of frequency bands and having center frequencies in a harmonic relation to one another;

wherein the control parameters from the analyzing means are arranged to set automatically in real time the gain and steepness of each said filter in the series of filters in order to adjust the filtering of each filter and control the output according to the level and quality of sound within the environmental space, and where the thus controlled series of filters are arranged to transform the frequency characteristics of the input signal by building harmonic elements on the received acoustic energy to provide masking sound;

means responsive to the output from the series of filters for generating an electrical output signal; and output means for converting the output signal into masking sound for modifying sound within the environmental space;

a number of microphones for sensing environmental sound and for generating at least one said electrical input signal; and a number of speakers comprising the output means for outputting sound back into the environmental space.

16. The system of claim 15, wherein said microphones, said active means, and said speakers are integrated into a medium.

17. The system of claim 16, wherein said medium comprises a sound absorbing medium.

18. The system of claim 17, wherein said sound absorbing medium is selected from the group consisting of: nylon, polyester, rubber, polyurethane, Kevlar, carbon-fiber epoxy, or a combination thereof.

19. The system of claim 16, wherein said medium comprises a sound reflecting medium.

20. The system of claim 19, wherein said sound reflecting medium is selected from the group consisting of: steel, plastic, or a combination thereof.

21. The system of claim 15, wherein said microphones, said active means, and said speakers are arranged freely in space.

22. The system of claim 16, wherein said medium comprises a sound curtain.

23. The system of claim 22, wherein said sound curtain comprises a number of curtain modules affixed to one another.

24. The system of claim 16, further comprising a power amplifier for amplifying said sensed environmental sound.

25. The system of claim 16, wherein said number of microphones is greater than one, said microphones electrically connected in parallel.

26. The system of claim 16, wherein said number of speakers is greater than one, said speakers electrically connected in parallel.

27. The system of claim 15, wherein said series of filters comprise digital filters.

28. The system of claim 15, wherein each of said bandpass filters has a center frequency, with one of said bandpass filters having a center frequency designated as a base frequency, and each of the other bandpass filters having a center frequency substantially equal to an integer multiple of said base frequency.

29. The system of claim 28, wherein said center frequencies are associated with a musical chord.

30. A sound curtain comprising:

a sound partitioning screen for producing a discontinuity in a sound conducting medium in an environmental space;

a number of exciters affixed to said sound partitioning screen; and active means for transforming sensed sound from said environmental space into an output sound by building harmonic elements on said sound adjusted to provide masking sound, said active means comprising means for receiving acoustic energy representing sound from the environmental space and for converting the acoustic energy into an electrical input signal;

means for receiving and analyzing the input signal into a plurality of frequency bands to derive control parameters;

a series of bandpass filters for receiving and filtering the input signal for generating an output, said bandpass filters corresponding in number to the plurality of frequency bands and having center frequencies in a harmonic relation to one another, wherein the control parameters from the analyzing means are arranged to set automatically in real time the gain and the steepness of each said filter in the series of filters in order to adjust the filtering of each said filter and control the output according to the level and quality of sound within the environmental space, and wherein the thus controlled series of filters are arranged to transform the frequency characteristics of the input signal by building harmonic elements on the received acoustic energy to provide masking sound;

means responsive to the output from the series of filters for generating an electrical signal; and output means for converting the output signal into masking sound for modifying sound within the environmental space;

and wherein said masking sound drives said exciters;

whereby the sensed sound of the environment is transformed into a musical sound output.

31. The sound curtain of claim 30 further comprising a number of sensors for sensing said sound from said environment of said sound partitioning screen, wherein said sensors are affixed to said sound partitioning screen.

32. The sound curtain of claim 31, wherein said sensors comprise microphones.

33. The sound curtain of claim 31, wherein said number of sensors and said number of exciters are respectively affixed on opposite sides of said sound partitioning screen.

34. The sound curtain of claim 31, wherein said exciters comprise speakers.

35. The sound curtain of claim 31, wherein said sound partitioning screen comprises a sound absorber.

36. The sound curtain of claim 31, wherein said sound partitioning screen comprises a sound reflector.

37. The sound curtain of claim 31, further comprising electrically conductive pathways.

38. The sound curtain of claim 37, wherein said electrically conductive pathways connect said exciters to said processing circuitry.

39. The sound curtain of claim 37, wherein said electrically conductive pathways are integrally molded within said sound partitioning screen.

40. The sound curtain of claim 37, wherein said electrically conductive pathways are defined by electrically conductive ink printed on the surface of said sound partitioning screen.

* * * * *